US009545983B2

(12) United States Patent
Terada et al.

(10) Patent No.: US 9,545,983 B2
(45) Date of Patent: Jan. 17, 2017

(54) JET PROPELLED WATERCRAFT

(71) Applicant: YAMAHA HATSUDOKI KABUSHIKI KAISHA, Iwata-shi, Shizuoka (JP)

(72) Inventors: Kohei Terada, Shizuoka (JP); Hironobu Miura, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 14/729,215

(22) Filed: Jun. 3, 2015

(65) Prior Publication Data

US 2016/0031539 A1 Feb. 4, 2016

(30) Foreign Application Priority Data

Aug. 1, 2014 (JP) ..... 2014-158127

(51) Int. Cl.

| | |
|---|---|
| ***B63H 11/04*** | (2006.01) |
| ***B63B 35/73*** | (2006.01) |
| ***B63H 21/30*** | (2006.01) |
| *F02M 35/16* | (2006.01) |

(52) U.S. Cl.

CPC ..... *B63H 11/04* (2013.01); *B63B 35/731* (2013.01); *B63H 21/305* (2013.01); *F02M 35/168* (2013.01)

(58) Field of Classification Search

CPC . B63B 35/731; B63B 2770/00; B63H 20/001; B63H 21/30; F02M 35/168; F02M 35/167

See application file for complete search history.

(56) References Cited

U.S. PATENT DOCUMENTS 7,249,987 B2 * 7/2007 Noda ..... F02M 35/168 114/55.5

2003/0045188 A1 * 3/2003 Matsuda ..... B63B 35/731 440/89 R

FOREIGN PATENT DOCUMENTS

JP 2002-114192 A 4/2002

* cited by examiner

*Primary Examiner* — Andrew Polay

(74) *Attorney, Agent, or Firm* — Keating and Bennett, LLP

(57) ABSTRACT

A jet propelled watercraft includes a watercraft body, an engine in the watercraft body, a jet pump configured to generate a jet thrust by a driving force of the engine, an intake pipe configured to supply air to the engine, an air intake box, and a filter. The air intake box includes a connecting port connected to the intake pipe and an inlet configured to take in ambient air. The filter is disposed in a space in an internal space of the air intake box. The filter divides the space into a lower region and an upper region. The lower region is connected to the inlet and the upper region is located higher than the lower region and connected to the connecting port. The filter is configured to clean air taken into the internal space from the inlet and directed to the connecting port.

13 Claims, 17 Drawing Sheets

JET PROPELLED WATERCRAFT

BACKGROUND OF THE INVENTION

1. Field of the Invention

The present invention relates to a jet propelled watercraft.

2. Description of the Related Art

A small vessel disclosed in Japanese Patent Application Publication No. 2002-114192 is provided with an internal combustion engine and an intake device configured to supply air to the internal combustion engine in the body. The intake device includes an intake pipe extending upward from a cylinder of the internal combustion engine, an intake chamber covering an upper end of the intake pipe, and an air filter provided continuously from the intake chamber. The air filter includes a filter case having an internal space communicating with an interior of the intake chamber in a horizontal direction and an element unit accommodated in an interior of the filter case for cleaning air.

The element unit includes an element having an annular shape in a plan view and an upper plate and lower plate that sandwich the element from the top and bottom. A first end portion of an air induction pipe opens in a space surrounded by the upper plate, the lower plate, and the element having a tubular shape, and a second end portion of the air induction pipe opens under the filter case.

Air is cleaned by flowing in the space surrounded by the upper plate, the lower plate, and the element via the air induction pipe and passing through the element. The air having passed through the element moves from the interior of the filter case to the interior of the intake chamber, and is supplied to the cylinder from the intake pipe in the intake chamber.

When the intake chamber and filter case described in Japanese Patent Application Publication No. 2002-114192 are configured as a single air intake box, an internal space of the air intake box is divided into an upstream space surrounded by the element which is disposed between the upper plate and lower plate and oriented in the vertical direction, and a downstream space where air having passed through the element exists. Thus, when water flows into the upstream space, the water is likely to run down under the element to reach the downstream space, and it is possible for the water to enter into the cylinder.

SUMMARY OF THE INVENTION

In order to overcome the previously unrecognized and unsolved challenges described above, a preferred embodiment of the present invention provides a jet propelled watercraft including a watercraft body, an engine that includes a crankshaft that rotates about a crank axis extending in a longitudinal direction of the watercraft body, and is accommodated in the watercraft body, a jet pump configured to generate a jet thrust by sucking in and ejecting water by a driving force of the engine, an intake pipe connected to the engine and configured to supply air to the engine, an air intake box, and a filter. The air intake box includes a connecting port connected to the intake pipe, an inlet configured to take in ambient air, and an internal space configured to connect the connecting port and the inlet to each other such that fluid flows between the connecting port and the inlet. The filter is disposed in a space included in the internal space and divides the space into a lower region and an upper region. The lower region is connected to the inlet, and the upper region is located higher than the lower region and connected to the connecting port. The filter is configured to clean air taken into the internal space from the inlet and directed to the connecting port.

According to this arrangement, the air intake box takes in ambient air into the internal space from the inlet. The filter disposed in the space defining a portion of the internal space cleans the air taken into the internal space. The cleaned air is directed to the connecting port in the internal space, and supplied to the engine by the intake pipe from the connecting port.

The filter divides the space in which the filter is disposed into the lower region connected to the inlet and the upper region located higher than the lower region and connected to the connecting port. In this case, a fluid that flows inside the internal space from the inlet toward the connecting port needs to rise when moving to the upper region from the lower region. Thus, even when water flows into the internal space from the inlet, because the water has difficulty in rising from the lower region to the upper region due to its own weight, it thus cannot reach the connecting port. Accordingly, the water also cannot reach the engine via the connecting port.

As a result, when water flows into the interior of the air intake box, entry thereof into the engine is prevented.

In a preferred embodiment of the present invention, the connecting port is preferably disposed higher than the filter.

According to this arrangement, even if water having flowed into the internal space passes through the filter, the water cannot reach the connecting port disposed higher than the filter due to its own weight. Accordingly, when water flows into the interior of the air intake box, entry thereof into the engine is further prevented.

In a preferred embodiment of the present invention, the air intake box is preferably accommodated in the watercraft body, and the inlet is preferably disposed higher than a water level in the watercraft body in case water enters into the watercraft body.

According to this arrangement, even when water enters into the watercraft body, because the inlet is disposed higher than the water level in the watercraft body, inflow of water from the inlet to the internal space is prevented.

In a preferred embodiment of the present invention, the air intake box preferably include a passage included in the internal space. The passage is preferably configured to connect the inlet and the lower region to each other such that fluid flows between the inlet and the lower region. The passage preferably extends obliquely downward and is connected at its lower end to the lower region. The filter is preferably located higher than a connecting portion of the passage and the lower region.

According to this arrangement, a fluid that flows along the passage obliquely downward from the inlet toward the lower region, when having flowed in the lower region beyond the connecting portion of the passage and the lower region, cannot reach the filter unless its flow direction is changed to upward. In this case, water having flowed into the passage from the inlet is urged by the passage so as to flow obliquely downward. The water that flows along the passage, when having flowed in the lower region, thus cannot change its flow direction to upward due to inertial force, and thus cannot reach the filter. Thus, the water that flows along the passage also cannot pass through the filter to reach the connecting port. Accordingly, when water flows into the interior of the air intake box, entry thereof into the engine is further prevented.

In a preferred embodiment of the present invention, the air intake box preferably includes a passage included in the internal space and a separation surface that is a portion of a surface defining the lower region. The passage is preferably configured to connect the inlet and the lower region to each other such that fluid flows between the inlet and the lower region. The separation surface is preferably configured to separate moisture from the air by having the air pass through the passage and flow into the lower region colliding therewith.

According to this arrangement, the fluid that flows along the passage from the inlet toward the lower region, when having passed through the passage to flow into the lower region, collides with the separation surface. The fluid is thus separated into air and moisture. The air rises from the lower region to reach the upper region. On the other hand, the water has difficulty in rising from the lower region to the upper region due to its own weight, and thus accumulates in the lower region without reaching the connecting port. Accordingly, when water flows into the interior of the air intake box, entry thereof into the engine is further prevented.

In a preferred embodiment of the present invention, the air intake box preferably includes a bottom wall defining a lower end of the lower region, and in the bottom wall, an outlet configured to discharge water accumulated in the lower region is preferably provided.

According to this arrangement, because water accumulated in the lower region is discharged from the outlet, the water accumulated in the lower region is prevented from reaching the connecting port. Accordingly, when water flows into the interior of the air intake box, entry thereof into the engine is further prevented.

In a preferred embodiment of the present invention, the air intake box preferably includes a valve that opens and closes the outlet.

According to this arrangement, due to the valve opening the outlet when a certain amount of water has accumulated in the lower region, the certain amount of water accumulated in the lower region is collectively discharged.

In a preferred embodiment of the present invention, a portion of the passage is preferably provided in an upper portion of the air intake box.

According to this arrangement, the passage of which a portion is provided in an upper portion of the air intake box inevitably includes a portion extending downward toward the lower region. A fluid that flows along the passage downward toward the lower region thus needs to change its flow direction to upward in a section from the passage to the upper region. In this case, water having flowed into the passage from the inlet is urged by the passage so as to flow downward. The water that flows along the passage thus cannot change its flow direction to upward due to inertial force, and thus cannot reach the upper region and also cannot reach the connecting port. Accordingly, when water flows into the interior of the air intake box, entry thereof into the engine is further prevented.

In a preferred embodiment of the present invention, the air intake box preferably includes a cover portion defining an upper portion of the air intake box and a main body portion which is a portion other than the cover portion and to and from which the cover portion is attached and detached.

According to this arrangement, separating the air intake box into the cover portion and the main body portion allows maintenance in the internal space of the air intake box to be easily performed.

Another preferred embodiment of the present invention provides a jet propelled watercraft including a watercraft body, an engine that includes a first coupling portion, and is accommodated in the watercraft body, a jet pump configured to generate a jet thrust by sucking in and ejecting water by a driving force of the engine, and an air intake box that includes a second coupling portion mounted on the first coupling portion, and is configured to turn using the first coupling portion defining a fulcrum and mounted on the engine via a turning operation.

According to this arrangement, the air intake box is easily mounted on the engine without being supported from below by mounting the second coupling portion of the air intake box on the first coupling portion of the engine and then turning the air intake box about a fulcrum of the first coupling portion. Thus, stability of the air intake box with respect to the engine is improved.

In another preferred embodiment of the present invention, the second coupling portion is preferably mounted on an upper portion of the air intake box.

According to this arrangement, by turning the air intake box about a fulcrum of the first coupling portion mounted on the second coupling portion on an upper portion of the air intake box, the air intake box is more easily mounted on the engine without being supported from below. Thus, the stability of the air intake box with respect to the engine is further improved.

In another preferred embodiment of the present invention, the jet propelled watercraft preferably includes an intake pipe extending from the air intake box and connected to the engine and configured to supply air to the engine from the air intake box, and a direction in which the intake pipe extends and a turning direction of the air intake box when mounted on the engine is preferably coincident or substantially coincident.

According to this arrangement, by turning and mounting the air intake box on the engine, the intake pipe extending from the air intake box is also connected to the engine. Thus, the stability of the air intake box with respect to the engine is further improved.

In another preferred embodiment of the present invention, the jet propelled watercraft preferably includes a third coupling portion provided on a lower portion of the air intake box and mounted on the engine in the air intake box.

According to this arrangement, due to the third coupling portion provided on a lower portion of the air intake box being mounted on the engine, the lower portion of the air intake box is fixed to the engine.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, preferred embodiments of the present invention will be described in detail with reference to the accompanying drawings.

Figure 1:
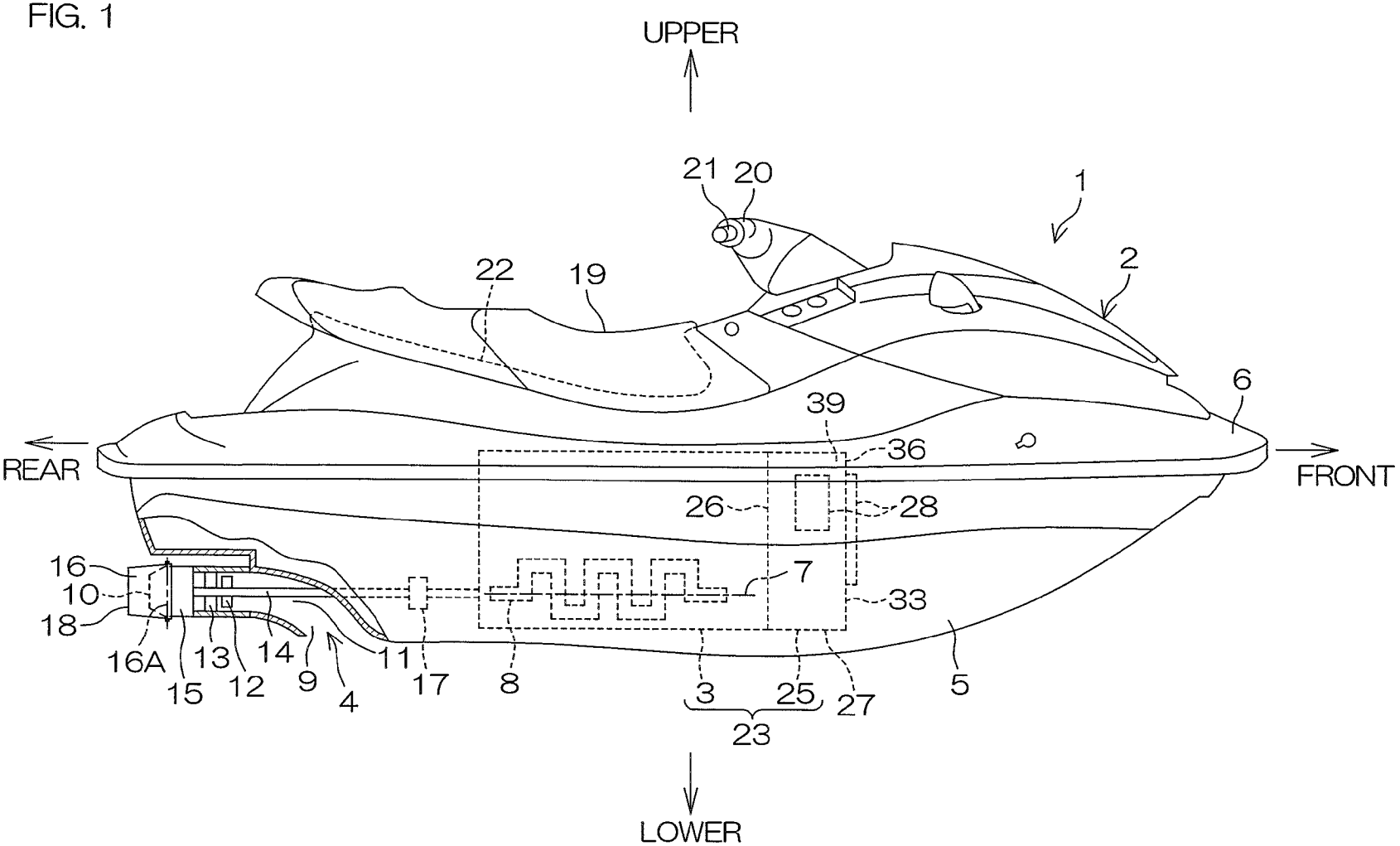
FIG. 1 is a schematic view of a jet propelled watercraft according to a preferred embodiment of the present invention.

FIG. 1 is a schematic view of a jet propelled watercraft 1 according to a preferred embodiment of the present invention. A right-left direction in FIG. 1 is defined as the front-rear direction of the jet propelled watercraft 1, the right side in FIG. 1 is defined as the front of the jet propelled watercraft 1, and the right-left direction of the jet propelled watercraft 1 faces the traveling direction of the jet propelled watercraft 1. Thus, the near side in a direction perpendicular to the sheet of FIG. 1 corresponds to the right side of the jet propelled watercraft 1, and the far side in a direction perpendicular to the sheet of FIG. 1 corresponds to the left side of the jet propelled watercraft 1.

As shown in FIG. 1, the jet propelled watercraft 1 includes a watercraft body 2, an engine 3 accommodated in an interior of the watercraft body 2, and a jet pump 4 mounted on a rear portion of the watercraft body 2.

The watercraft body 2 includes a hull 5 that defines the bottom of the watercraft and a deck 6 disposed above the hull 5. The watercraft body 2 extends in the front-rear direction.

The engine 3 is disposed between the hull 5 and the deck 6 in an up-down direction. The engine 3 is disposed in front of the jet pump 4. The engine 3 is preferably an internal combustion engine including a crankshaft 8 that rotates about a crank axis 7 extending in the front-rear direction.

The jet pump 4 is driven by the engine 3. The jet pump 4 sucks in water from the watercraft bottom and ejects the water to the outside of the watercraft (exterior of the watercraft body 2) by a driving force of the engine 3. The jet pump 4 thus generates a jet thrust to propel the jet propelled watercraft 1 forward.

In detail, the jet pump 4 includes an intake 9 into which water outside the watercraft is sucked in, an outlet 10 from which the water sucked in from the intake 9 is ejected rearward, and a flow passage 11 that guides the water sucked into the intake 9 to the outlet 10. The jet pump 4 further includes an impeller 12 (rotor vane) and a stator vane 13 that are disposed in the flow passage 11, a driveshaft 14 coupled to the impeller 12, a nozzle 15 that defines the outlet 10, and a deflector 16 that deflects the direction of water ejected rearward from the nozzle 15 to the right and left.

The intake 9 opens at the watercraft bottom, and the outlet 10 opens rearward farther to the rear than the intake 9. The driveshaft 14 extends in the front-rear direction. A front end portion of the driveshaft 14 is disposed inside the watercraft, and a rear end portion of the driveshaft 14 is disposed in the flow passage 11. The front end portion of the driveshaft 14 is coupled to the crankshaft 8 of the engine 3 via a coupling 17 or the like. The impeller 12 is coupled to the driveshaft 14. The stator vane 13 is disposed behind the impeller 12, and the nozzle 15 is disposed behind the stator vane 13. The impeller 12 is rotatable about a central axis of the driveshaft 14 in the flow passage 11. The stator vane 13 is fixed with respect to the flow passage 11. The nozzle 15 is fixed to the watercraft body 2.

The impeller 12 is driven to rotate about the central axis of the driveshaft 14 together with the driveshaft 14 by the engine 3. When the impeller 12 is driven to rotate, water is sucked into the flow passage 11 from the intake 9 and is fed from the impeller 12 to the stator vane 13. Due to the water fed by the impeller 12 and passing through the stator vane 13, a torsional water flow produced by rotation of the impeller 12 is reduced and the water flow is straightened. Thus, the flow-straightened water is fed from the stator vane 13 to the nozzle 15. The nozzle 15 preferably has a tubular shape extending in the front-rear direction, and the outlet 10 is defined by a rear end portion of the nozzle 15. The water fed to the nozzle 15 is thus jetted rearward from the outlet 10 of the rear end portion of the nozzle 15.

The deflector 16 extends rearward from the nozzle 15. The deflector 16 is coupled to the nozzle 15 and configured to rotate to the right and left about a deflector axis 16A extending in the up-down direction. The deflector 16 is hollow. The outlet 10 of the nozzle 15 is disposed in the deflector 16. The deflector 16 defines an ejection port 18 that opens rearward. The ejection port 18 is disposed behind the outlet 10. Water jetted rearward from the outlet 10 penetrates through an interior of the deflector 16 and is ejected rearward from the ejection port 18.

The jet propelled watercraft 1 includes a seat 19 on which a rider sits, a handle 20 that is operated to the right and left by the rider, and a throttle lever 21 mounted on the handle 20.

The seat 19 and the handle 20 are disposed above the watercraft body 2. The seat 19 and the handle 20 are supported by the watercraft body 2. The seat 19 and the handle 20 are disposed at a central portion of the jet propelled watercraft 1 in the right-left direction. The seat 19 is disposed behind the handle 20. The seat 19 is disposed on an upper portion of the watercraft body 2. An opening portion 22 that opens upward is provided in an upper portion of the watercraft body 2. The engine 3 is accommodated in the watercraft body 2 under the opening portion 22. The opening portion 22, in an ordinary state, is blocked from above by the seat 19. When performing maintenance on the interior of the watercraft body 2, the opening portion 22 is opened by the seat 19 being removed. A user such as the rider accesses the interior of the watercraft body 2 by opening the opening portion 22.

An output of the engine 3 is adjusted by operation of the throttle lever 21 by the rider. The deflector 16 of the jet pump 4 turns to the right and left according to an operation of the handle 20. Thus, the direction of water that is ejected from the jet pump 4 is changed to the right and left by the operation of the handle 20. The jet propelled watercraft 1 is thus steered.

Figure 2:
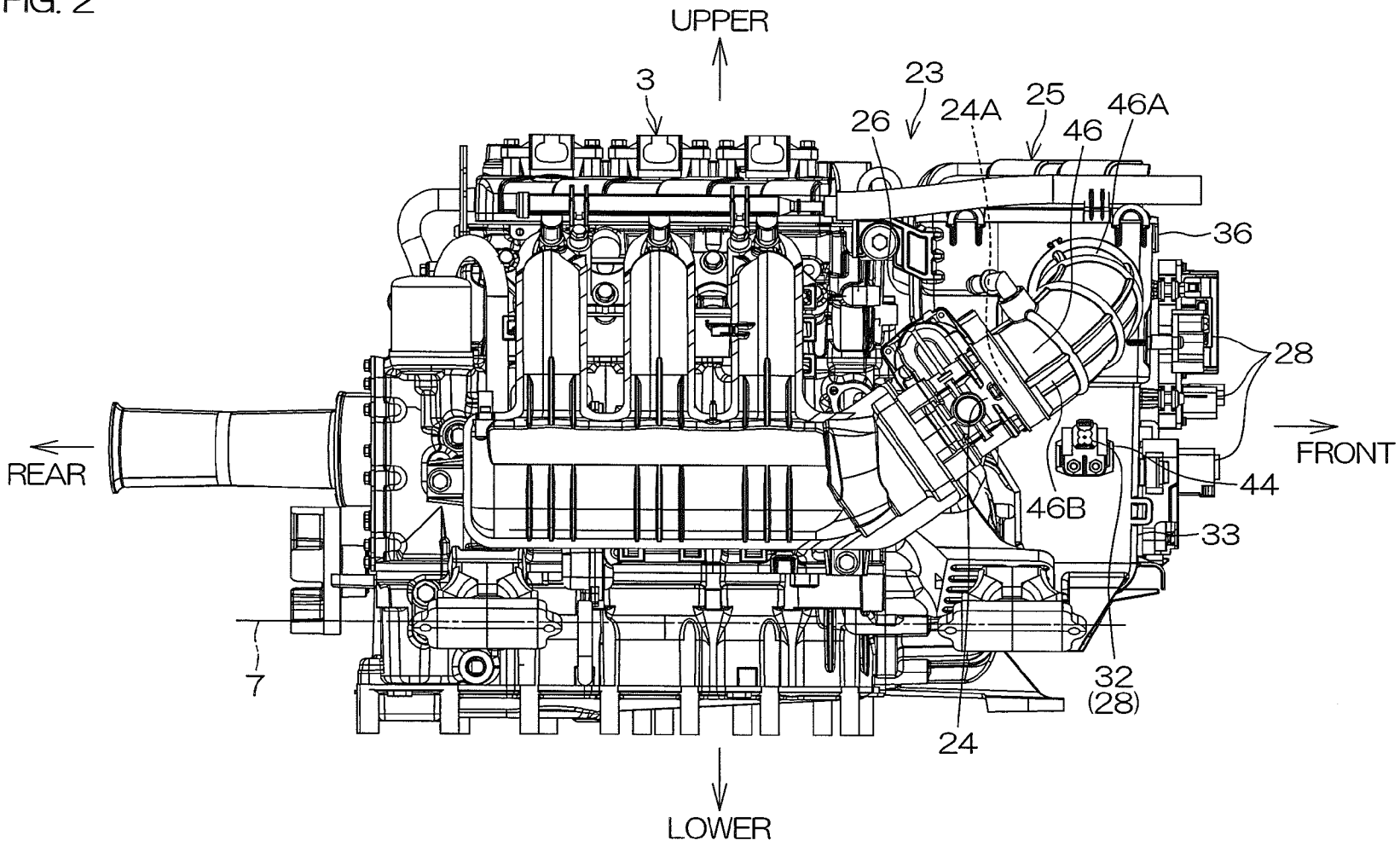
FIG. 2 is a side view of an engine unit provided in the jet propelled watercraft.

FIG. 2 is a right side view of an engine unit 23 provided in the jet propelled watercraft 1. The right side of FIG. 2 corresponds to the front of the jet propelled watercraft 1.

As shown in FIG. 2, a throttle body 24 configured to adjust the amount of air to be supplied to the engine 3 is provided on a right surface of the engine 3, for example. An intake-air inlet 24A configured to take in air is provided in a front surface of the throttle body 24. The intake-air inlet 24A preferably faces obliquely upward.

The jet propelled watercraft 1 further includes an air intake box 25 configured to supply air to the engine 3 via the throttle body 24. The air intake box 25 is accommodated in the interior of the watercraft body 2 together with the engine 3. The air intake box 25 is preferably disposed on the crank axis 7 extending in the front-rear direction, and disposed opposite to the engine 3 from the front so as to become aligned with the engine 3 on the crank axis 7. In the air intake box 25, a rear surface 26 is opposed to the engine 3. The air intake box 25 is mounted on the engine 3. The engine 3 and the air intake box 25 are preferably integral and together define an engine unit 23.

Figure 3:
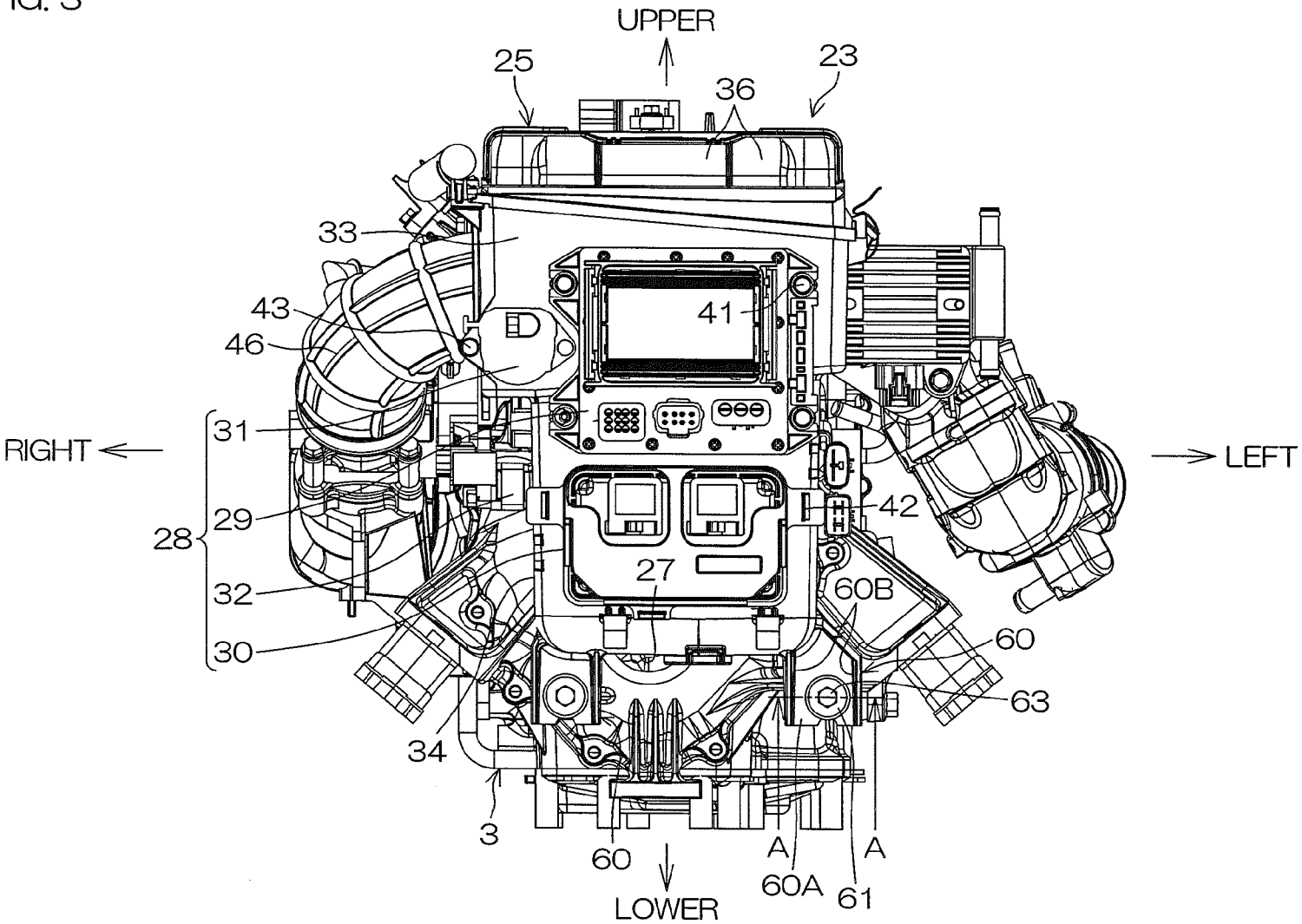
FIG. 3 is a front view of the engine unit.

FIG. 3 is a front view of the engine unit 23. The right-left direction of FIG. 3 is reverse to the right-left direction of the engine unit 23.

As shown in FIG. 3, the jet propelled watercraft 1 further includes electrical devices 28 that are mounted on a surface of the air intake box 25 that is different from both of the rear surface 26 and a lower surface 27. In the present preferred embodiment, a fuse box 29, an ECU 30 (Electronic Control Unit), an overturn switch 31, and a starter unit 32 are non-limiting examples of the electrical devices 28.

The fuse box 29 stores a plurality of fuses inserted in an electric circuit inside the jet propelled watercraft 1. The ECU 30 is an electrical component configured or programmed to control electrical devices provided in the jet propelled watercraft 1. The overturn switch 31 is an electrical component configured to detect an overturn (upset) of the jet propelled watercraft 1. The starter unit 32 is an electrical component configured to start the engine 3.

The fuse box 29, the ECU 30, and the overturn switch 31 are preferably mounted on a front surface 33 of the air intake box 25. The starter unit 32 is preferably mounted on a right surface 34 of the air intake box 25.

Figure 4:
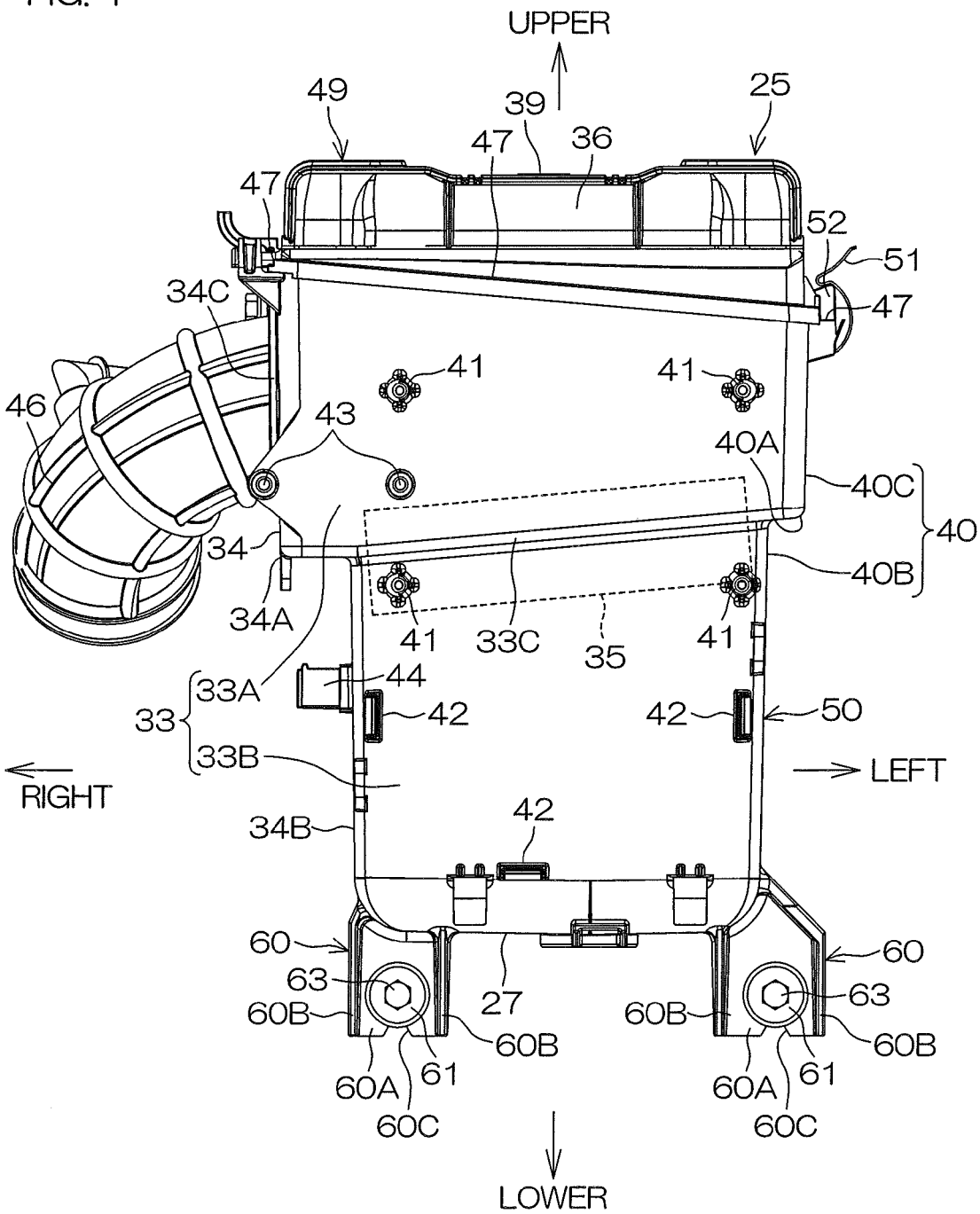
FIG. 4 is a front view of an air intake box provided in the engine unit.
Figure 5:
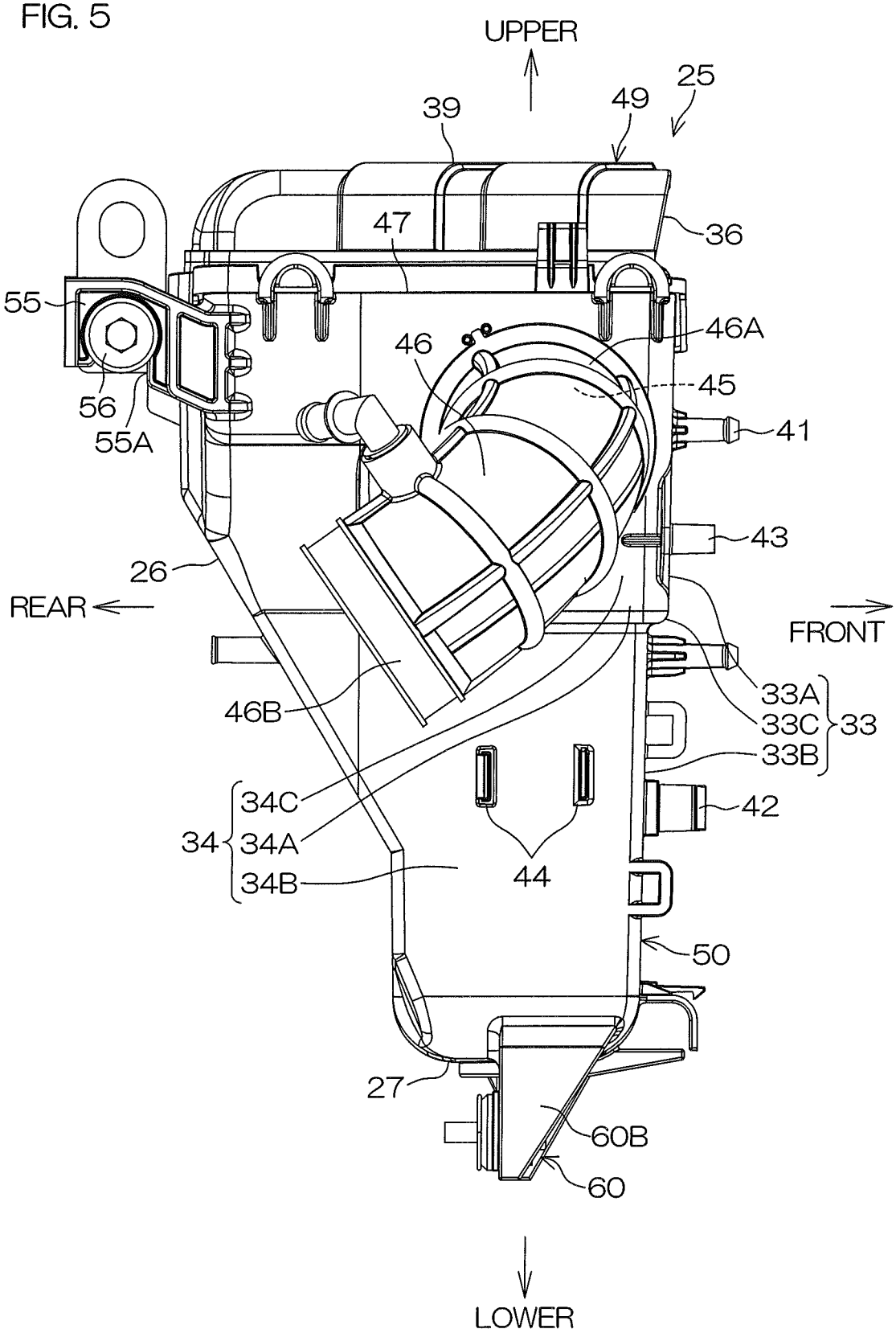
FIG. 5 is a side view of the air intake box.
Figure 6:
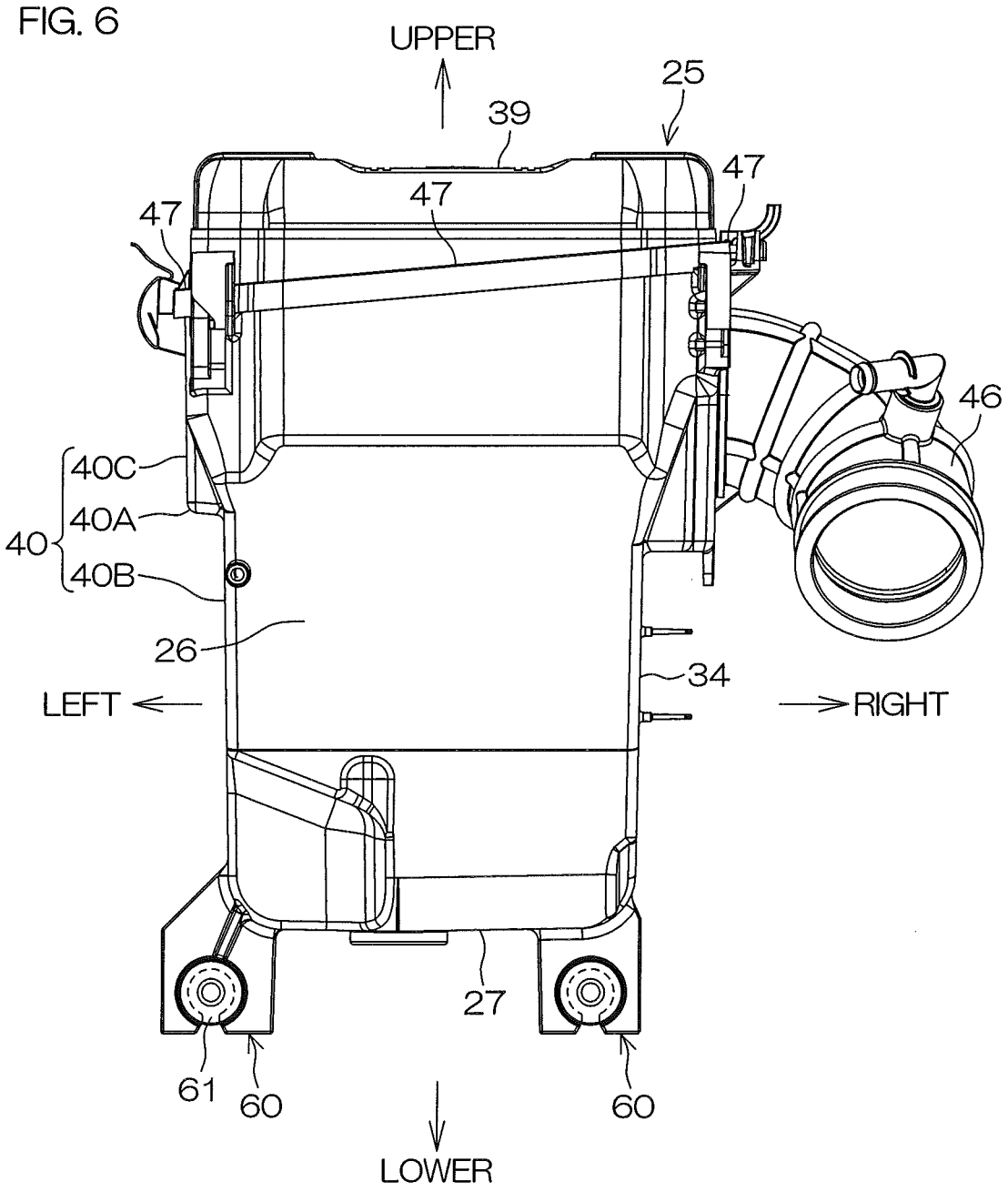
FIG. 6 is a rear view of the air intake box.
Figure 7:
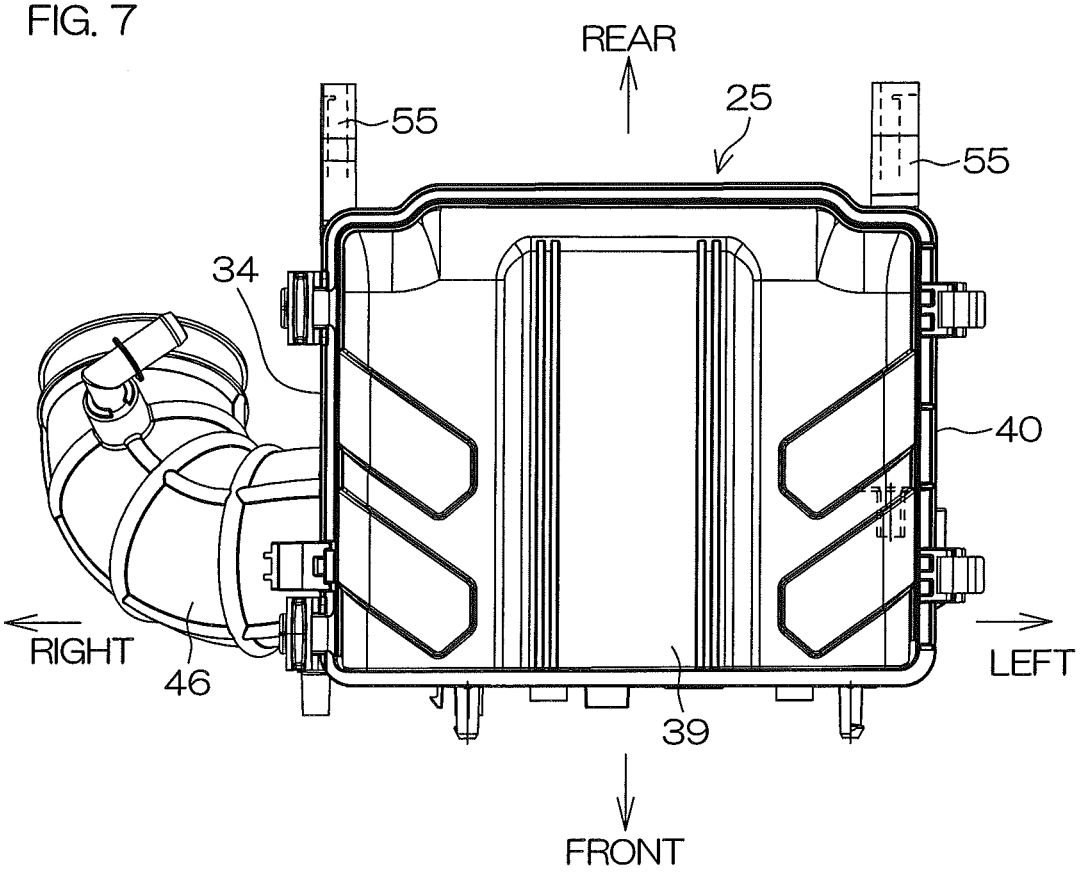
FIG. 7 is a plan view of the air intake box.
Figure 8:
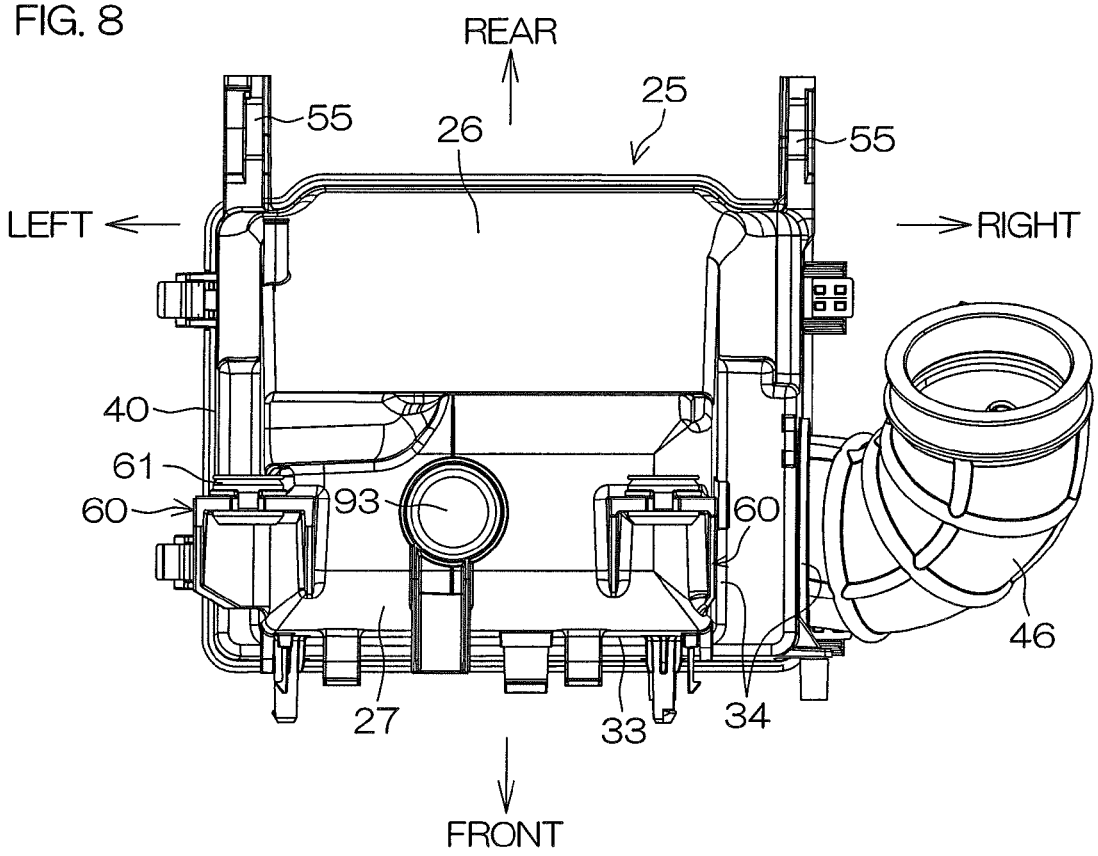
FIG. 8 is a bottom view of the air intake box.

FIG. 4 is a front view of the air intake box 25. FIG. 5 is a right side view of the air intake box 25. FIG. 6 is a rear view of the air intake box 25. FIG. 7 is a plan view of the air intake box 25. FIG. 8 is a bottom view of the air intake box 25. In FIG. 4 to FIG. 8, the air intake box 25 from which the electrical devices 28 have been removed is illustrated.

As shown in FIG. 4, the air intake box 25 is preferably made of a resin and has a hollow body that become more narrow toward the lower side (refer also to FIG. 5). The air intake box 25 includes a built-in filter 35 configured to clean air. The air intake box 25 includes an upper surface 39 and a left surface 40, in addition to the rear surface 26, the lower surface 27, the front surface 33, and the right surface 34 described above.

The front surface 33 includes an upper region 33A that occupies substantially an upper half thereof and a lower region 33B that occupies substantially a lower half thereof. The upper region 33A and the lower region 33B both preferably have rectangular or substantially rectangular shapes that are flat in the up-down and right-left directions, and extend perpendicularly or substantially perpendicularly to each other.

The lower region 33B is preferably smaller than the upper region 33A in the right-left direction. The lower region 33B is shifted to the rear farther than the upper region 33A (refer to FIG. 5). Thus, the front surface 33 includes a step 33C at a boundary between the upper region 33A and the lower region 33B. An inlet 36 configured to take in ambient air into the air intake box 25 is provided in an upper end portion of the upper region 33A. The inlet 36 is slender in the right-left direction, and communicates with an interior of the air intake box 25. Air taken into the air intake box 25 from the inlet 36 is cleaned by the built-in filter 35 of the air intake box 25.

A plurality of first mounting portions 41 on which the fuse box 29 is mounted are provided on the front surface 33. Due to each of the first mounting portions 41 being inserted through a hole (not shown) in the fuse box 29, the fuse box 29 is mounted on the air intake box 25 via the first mounting portions 41 (refer to FIG. 3).

A plurality of second mounting portions 42 on which the ECU 30 is mounted are provided on the front surface 33. Due to each of the second mounting portions 42 being inserted through a hole (not shown) in the ECU 30, the ECU 30 is mounted on the air intake box 25 via the second mounting portions 42 (refer to FIG. 3).

A plurality of third mounting portions 43 on which the overturn switch 31 is mounted are provided on the front surface 33. Due to each of the third mounting portions 42 being inserted through a hole (not shown) in the overturn switch 31, the overturn switch 31 is mounted on the air intake box 25 via the third mounting portions 43 (refer to FIG. 3).

As shown in FIG. 5, the right surface 34 includes a step 34A at the same position as that of the step 33C of the front surface 33 in the up-down direction. The right surface 34 includes a lower region 34B located lower than the step 34A and an upper region 34C located higher than the step 34A. The lower region 34B and the upper region 34C are both flat in the up-down and front-rear directions, and the lower region 34B is shifted to the left farther than the upper region 34C (refer to FIG. 4). The entire right surface 34 preferably has a triangular or substantially triangular shape that becomes more narrow toward the lower side. A front end edge of the right surface 34 other than at the step 34A extends perpendicularly or substantially perpendicularly thereto.

A plurality of fourth mounting portions 44 on which the starter unit 32 is mounted are provided in the lower region 34B. Due to each of the fourth mounting portions 44 being inserted through a hole (not shown) in the starter unit 32, the starter unit 32 is mounted on the air intake box 25 via the fourth mounting portions 44 (refer to FIG. 2).

A connecting port 45 is provided in the upper region 34C. The connecting port 45 communicates with the interior of the air intake box 25.

The air intake box 25 includes an intake pipe 46 that is connected to the connecting port 45. At least a portion of the intake pipe 46 is made of a flexible material such as rubber or resin.

The intake pipe 46 includes a first end portion 46A that is connected to the connecting port 45 and a second end portion 46B that is opposite to the first end portion 46A. The second end portion 46B is connected with respect to the intake-air inlet 24A of the throttle body 24 (refer to FIG. 2) by being inserted thereinto. That is, the intake pipe 46 extends from the connecting port 45 of the air intake box 25 and is connected to the intake-air inlet 24A of the engine 3. Thus, air cleaned by the filter inside the air intake box 25 flows into the intake pipe 46 from the connecting port 45 and is supplied to the engine 3 via the throttle body 24 by the intake pipe 46.

The intake pipe 46 is curved after extending rightward from the first end portion 46A and extends rearward to the second end portion 46B. When viewed from the right as shown in FIG. 5, the intake pipe 46 is inclined downward from the first end portion 46A toward second end portion 46B.

The intake pipe 46 and the air intake box 25 are preferably integral and unitary. In that case, a reduction in cost by a reduction in the number of components and downsizing is realized. Also, a gap into which water enters is prevented from being provided between the first end portion 46A of the intake pipe 46 and the air intake box 25.

Figure 10:
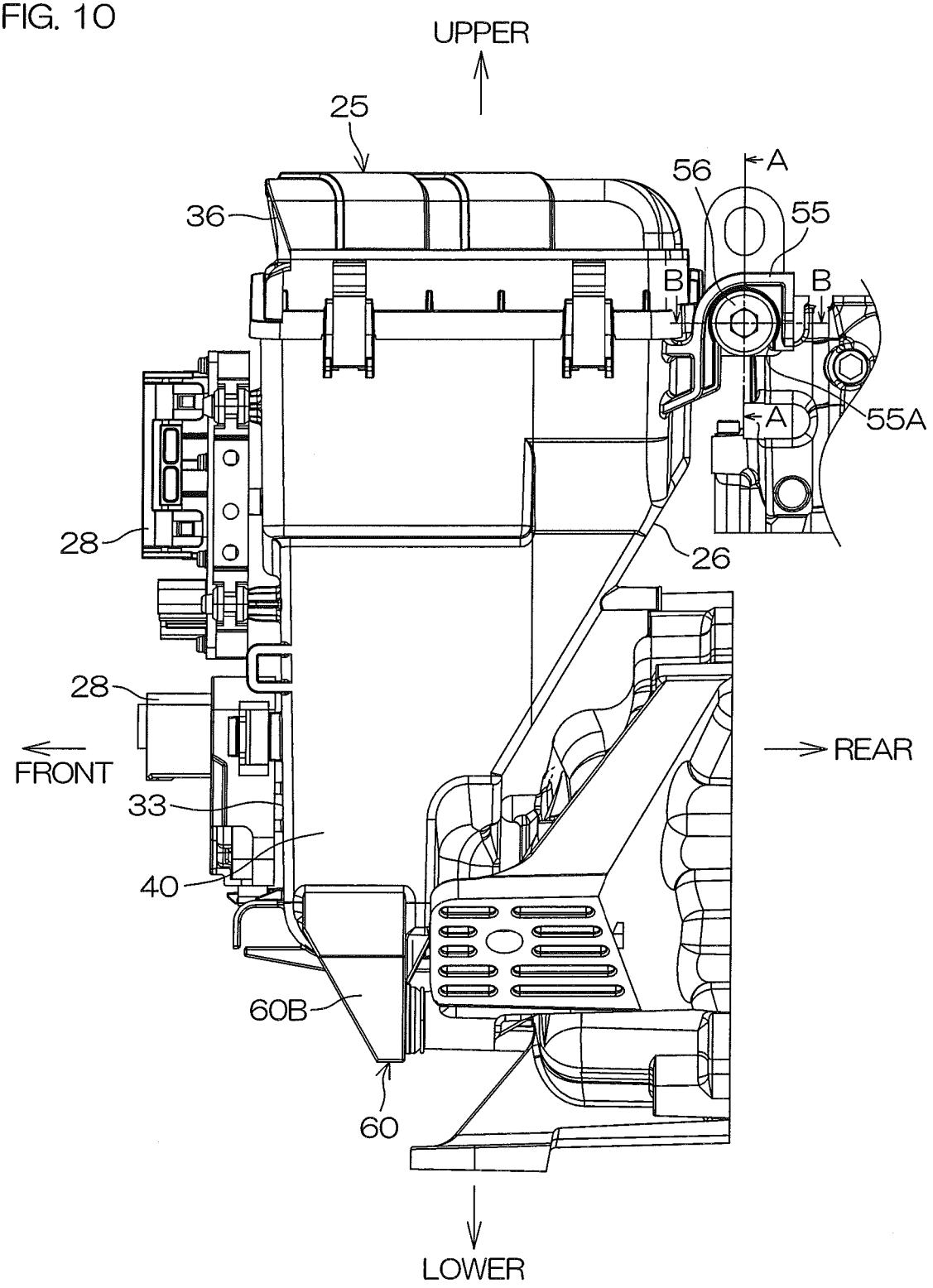
FIG. 10 is a side view of the principal area of the engine unit.

The left surface 40 shown in FIG. 6 also preferably has a triangular or a substantially triangular shape that is similar to that of the right surface 34 (refer also to FIG. 10). The rear surface 26 is arranged in a hanging manner between rear end edges of the right surface 34 and the left surface 40. At least a portion of the rear surface 26 is inclined forward as it extends downward (refer to FIG. 5).

The left surface 40 includes a step 40A at the same position as that of the step 33C of the front surface 33 in the up-down direction. The left surface 40 includes a lower region 40B located lower than the step 40A and an upper region 40C located higher than the step 40A. The lower region 40B and the upper region 40C are both flat in the up-down and front-rear directions, and the lower region 40B is shifted to the right farther than the upper region 40C.

The upper surface 39 and the lower surface 27 extend to the front and rear and the right and left. As shown in FIG. 7, the upper surface 39 preferably has, in a plan view, a rectangular or a substantially rectangular shape that is longer in the right-left direction. As shown in FIG. 8, the lower surface 27 preferably has, in a bottom view, a rectangular or a substantially rectangular shape that is longer in the right-left direction. The lower surface 27 is one size or more smaller than the upper surface 39.

As shown in FIG. 4 to FIG. 6, one boundary 47 across the front surface 33, the right surface 34, the left surface 40, and the rear surface 26 is defined on the air intake box 25.

As shown in FIG. 4, the boundary 47, in the upper region 33A of the front surface 33, at a position lower than the inlet 36, extends linearly so as to be inclined downward as it extends leftward. As shown in FIG. 5, the boundary 47, in an upper end portion of the upper region 34C of the right surface 34, extends horizontally in the front-rear direction. As shown in FIG. 6, the boundary 47, in an upper end portion of the upper region 40C of the left surface 40, extends horizontally in the front-rear direction. The boundary 47 of the left surface 40 is located lower than the boundary 47 of the right surface 34. The boundary 47, in an upper end portion of the rear surface 26, extends linearly so as to be inclined downward as it extends leftward.

Figure 9:
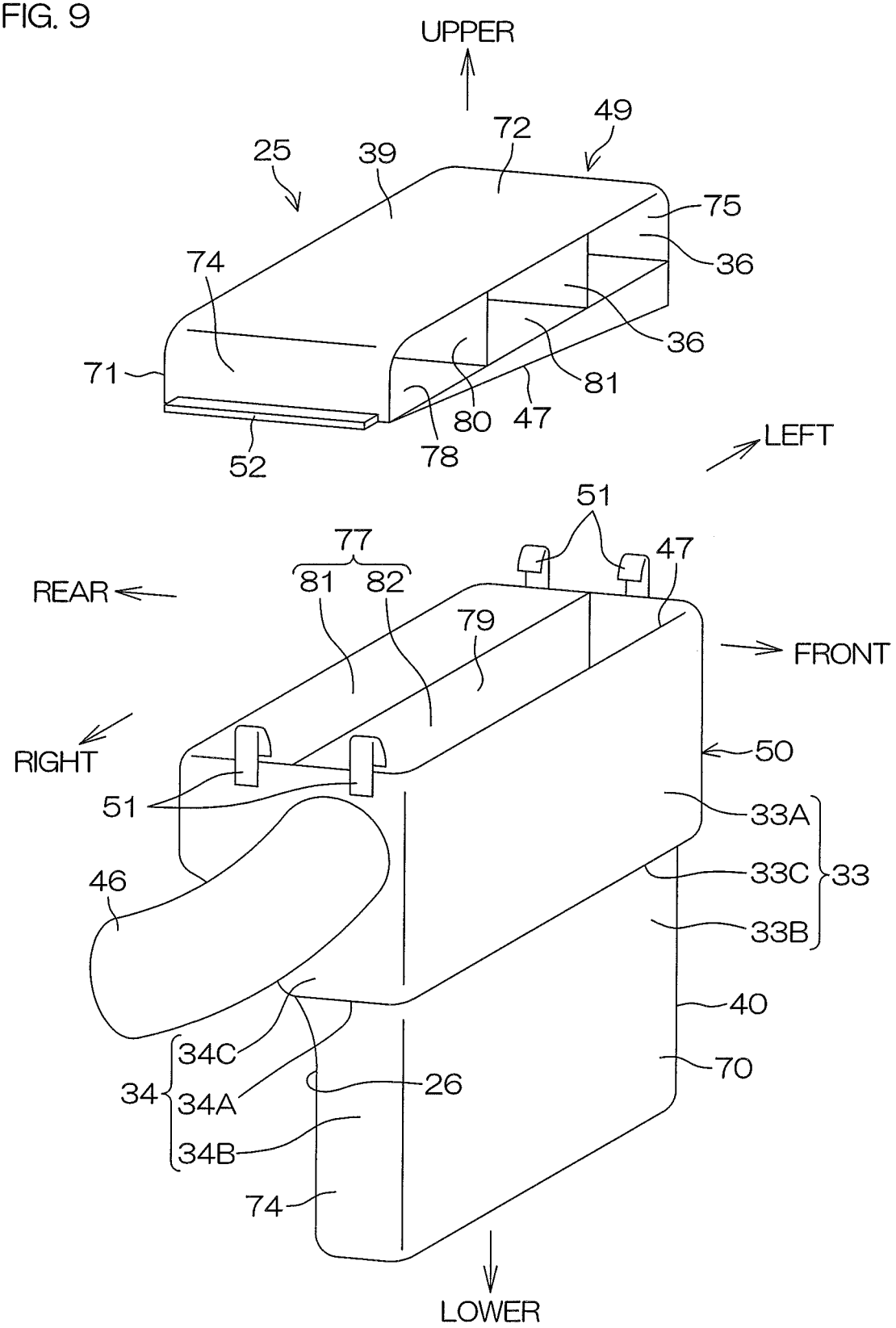
FIG. 9 is a schematic exploded perspective view of the air intake box.

FIG. 9 is a schematic exploded perspective view of the air intake box 25.

As shown in FIG. 9, the air intake box 25 is configured to separate into a cover portion 49 higher than the boundary 47 and a main body portion 50 lower than the boundary 47. The cover portion 49 defines an upper portion of the air intake box 25. The main body portion 50 is a portion other than the cover portion 49 in the air intake box 25, and the cover portion 49 is attached and detached with respect to the main body portion 50.

Fixing portions 51 and fixed portions 52 configured to attach and detach the cover portion 49 with respect to the main body portion 50 are provided on the air intake box 25. A plurality of (for example, two) fixing portions 51 are provided on each of the upper end portions of a right surface and a left surface of the main body portion 50. Each of the fixing portions 51 preferably includes, as an example, a hook projecting upward from an upper end of the main body portion 50 and bent in the right-left direction. The fixing portions 51 on the right surface of the main body portion 50 are bent to the left, and the fixing portions 51 on the left surface of the main body portion 50 are bent to the right. The fixed portion 52 includes, as an example, a rib extending in a streak along the front-rear direction, and provided on each of the lower end portions of a right surface and a left surface of the cover portion 49.

When the cover portion 49 is placed over the main body portion 50 from above and the fixing portions 51 on the right surface of the main body portion 50 are caught on the fixed portion 52 on the right surface of the cover portion 49 and the fixing portions 51 on the left surface of the main body portion 50 are caught on the fixed portion 52 (not shown) on the left surface of the cover portion 49, the cover portion 49 is attached to the main body portion 50. Conversely, when all fixing portions 51 are removed from the fixed portions 52 and the cover portion 49 is separated from the main body portion 50, the cover portion 49 is detached from the main body portion 50.

Although, in FIG. 9, the fixing portions 51 are simplified, a lever may be provided for each fixing portion 51, and the fixing portion 51 may be caught on the fixed portion 52 or the fixing portion 51 may come off the fixed portion 52 in conjunction with an operation of the lever. Also, the cover portion 49, when being attached and detached, may turn about a fulcrum of a right end portion or left end portion of the main body portion 50.

Figure 11A:
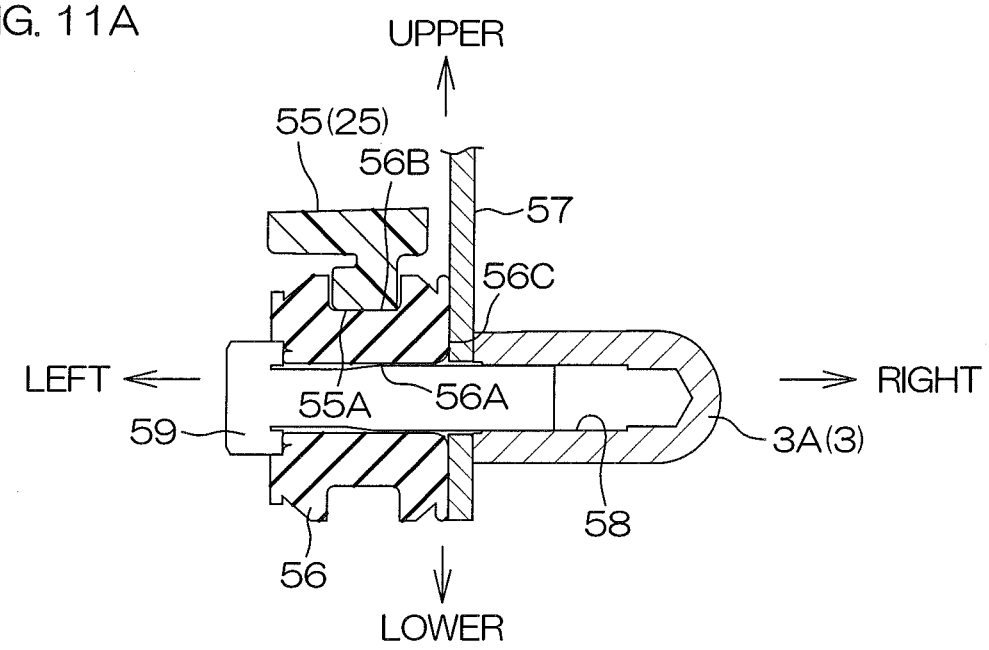
FIG. 11A is a sectional view taken along line A-A of FIG. 10.
Figure 11B:
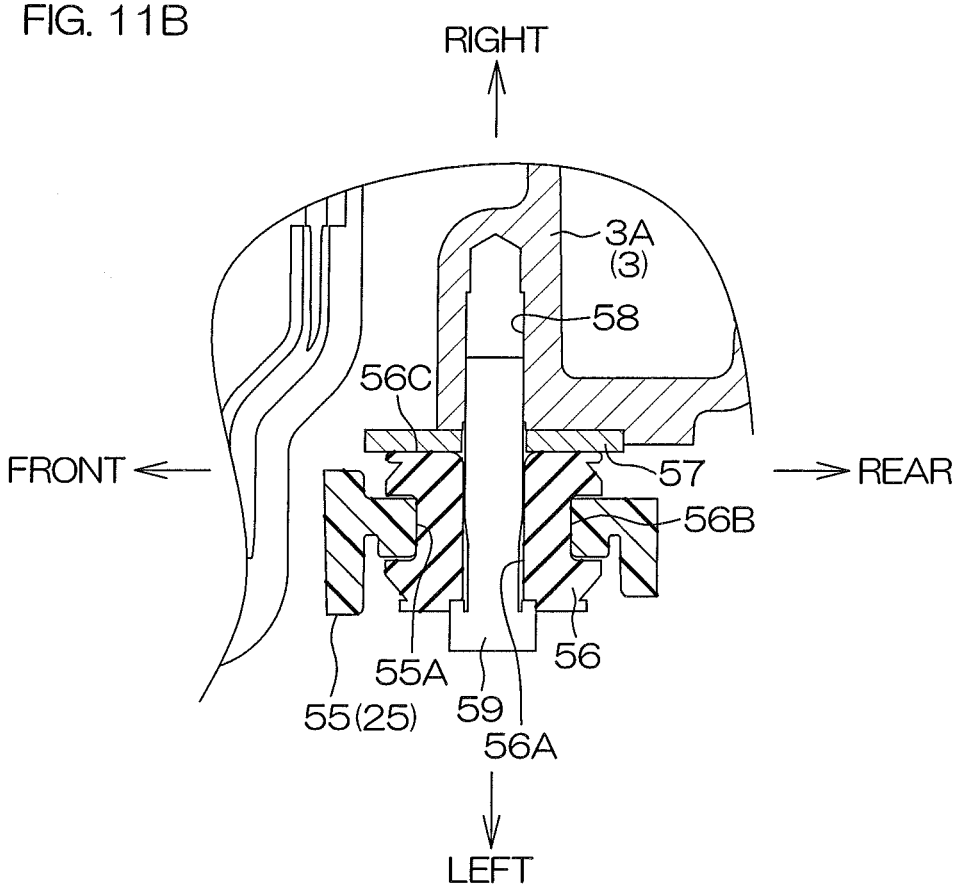
FIG. 11B is a sectional view taken along line B-B of FIG. 10.
Figure 12:
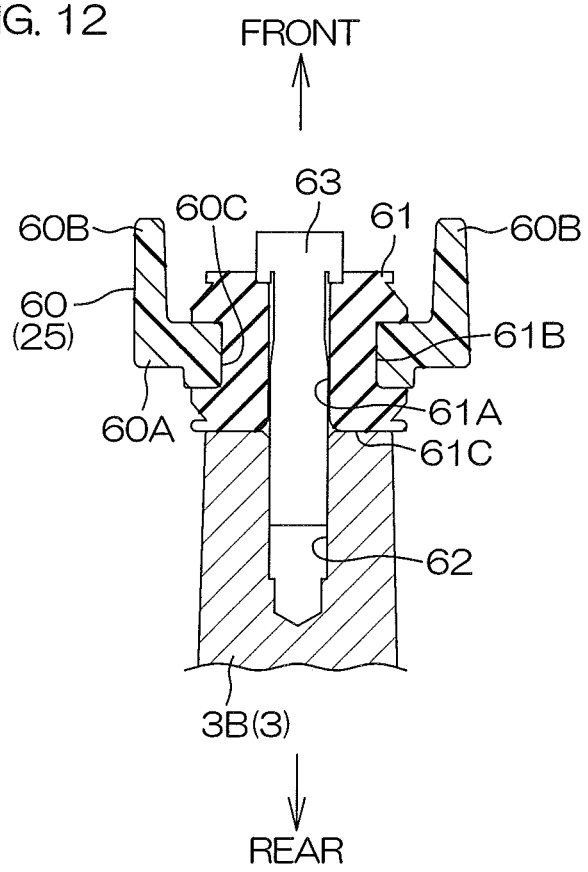
FIG. 12 is a sectional view taken along line A-A of FIG. 3.

FIG. 10 is a left side view of the principal area of the engine unit 23. FIG. 11A is a sectional view taken along line A-A of FIG. 10. FIG. 11B is a sectional view taken along line B-B of FIG. 10. FIG. 12 is a sectional view taken along line A-A of FIG. 3.

As shown in FIG. 10, upper coupling portions 55 defining second coupling portions configured to couple an upper portion of the air intake box 25 to the engine 3 are provided one each at each of the upper end portions of the right surface 34 and the left surface 40 (refer also to FIG. 5). Thus, the upper coupling portions 55 are disposed on an upper portion of the air intake box 25. Each of the upper coupling portions 55 includes an arm-shaped projecting farther to the rear than the rear surface 26. A cut-away 55A is defined at a rear end portion of each of the upper coupling portions 55. The cut-away 55A has a concave shape for which the rear end portion of the upper coupling portions 55 is cut away from below, and penetrates through the rear end portion of the upper coupling portions 55 in the right-left direction. The cut-aways 55A of the right and left upper coupling portions 55 are arranged at mutually overlapping positions when viewed in the right-left direction.

A vibration-proof member 56 is fit into the cut-away 55A from below. As shown in FIG. 11A and FIG. 11B, the vibration-proof member 56 is, for example, a cylindrical grommet including a hole 56A that penetrates through the vibration-proof member 56 in the right-left direction, and is preferably made of an elastic material such as rubber. At an outer peripheral surface of the vibration-proof member 56, a groove 56B extending along its circumferential direction is provided. A portion bordering the cut-away 55A in the upper coupling portions 55 is fit into the groove 56B. The portion bordering the cut-away 55A in the upper coupling portions 55 is, in the groove 56B, elastically sandwiched in the right-left direction by the vibration-proof member 56.

A first end surface 56C of the vibration-proof member 56 in the right-left direction is opposed to a rear end portion of the engine 3 in the right-left direction. A washer 57 is preferably interposed between the first end surface 56C and the engine 3. A screw hole 58 is located, in an upper portion of the engine 3, at a position overlapping the hole 56A of the vibration-proof member 56 when viewed in the right-left direction. The portion where the screw hole 58 is provided in the upper portion of the engine 3 is an upper coupling portion 3A defining a first coupling portion.

A bolt 59, for example, is inserted through the hole 56A of the vibration-proof member 56 in the right-left direction, and inserted into the screw hole 58 of the upper coupling portion 3A. The upper coupling portions 55 of the air intake box 25 are thus mounted on the upper coupling portions 3A of the engine 3 via the vibration-proof members 56.

As shown in FIG. 4, lower coupling portions 60 defining third coupling portions configured to couple a lower portion of the air intake box 25 to the engine 3 are provided one each at both end portions of the lower surface 27 in the right-left direction. That is, the lower coupling portions 60 are provided on a lower portion of the air intake box 25. Each of the lower coupling portions 60 projects downward from the lower surface 27. Each of the lower coupling portions 60 includes an integral and unitary main body portion 60A that is flat in the up-down and right-left directions and thin in the front-rear direction, and a pair of side plate portions 60B that extend forward from both end portions of the main body portion 60A in the right-left direction. The main body portion 60A preferably has a rectangular or substantially rectangular shape when viewed in the front-rear direction. Each side board portion 60B preferably has a triangular or substantially triangular shape when viewed in the right-left direction (refer to FIG. 5).

A cut-away 60C is provided in the main body portion 60A of each of the lower coupling portions 60. The cut-away 60C preferably has a concave shape of which the main body portion 60A is cut away from below, and penetrates through the main body portion 60A in the front-rear direction.

A vibration-proof member 61 is fit into the cut-away 60C from below. As shown in FIG. 12, the vibration-proof member 61 includes, for example, a cylindrical grommet including a hole 61A that penetrates through the vibration-proof member 61 in the front-rear direction, and is preferably made of an elastic material such as rubber. At an outer peripheral surface of the vibration-proof member 61, a groove 61B extending along its circumferential direction is provided. A portion bordering the cut-away 60C in the main body portion 60A is fit into the groove 61B. The portion bordering the cut-away 60C in the main body portion 60A is, in the groove 61B, elastically sandwiched in the front-rear direction by the vibration-proof member 61.

A rear end surface 61C of the vibration-proof member 61 is in contact with a front end portion of the engine 3 from the front. A screw hole 62 is located, in a lower portion of the engine 3, at a position overlapping the hole 61A of the vibration-proof member 61 when viewed from the front. The portion where the screw hole 62 is provided in the lower portion of the engine 3 is a lower coupling portion 3B.

A bolt 63 is inserted through the hole 61A of the vibration-proof member 61 from the front, and inserted into the screw hole 62 of the lower coupling portion 3B. The right and left lower coupling portions 60 of the air intake box 25 are thus mounted on the lower coupling portion 3B of the engine 3 via the vibration-proof members 61 (refer to FIG. 3).

As described above, the air intake box 25 mounted via the intake pipe 46, the vibration-proof members 56, and the vibration-proof members 61 is elastically supported by the engine 3.

Next, a non-limiting example of a procedure for mounting the air intake box 25 on the engine 3 will be described.

Figure 13:
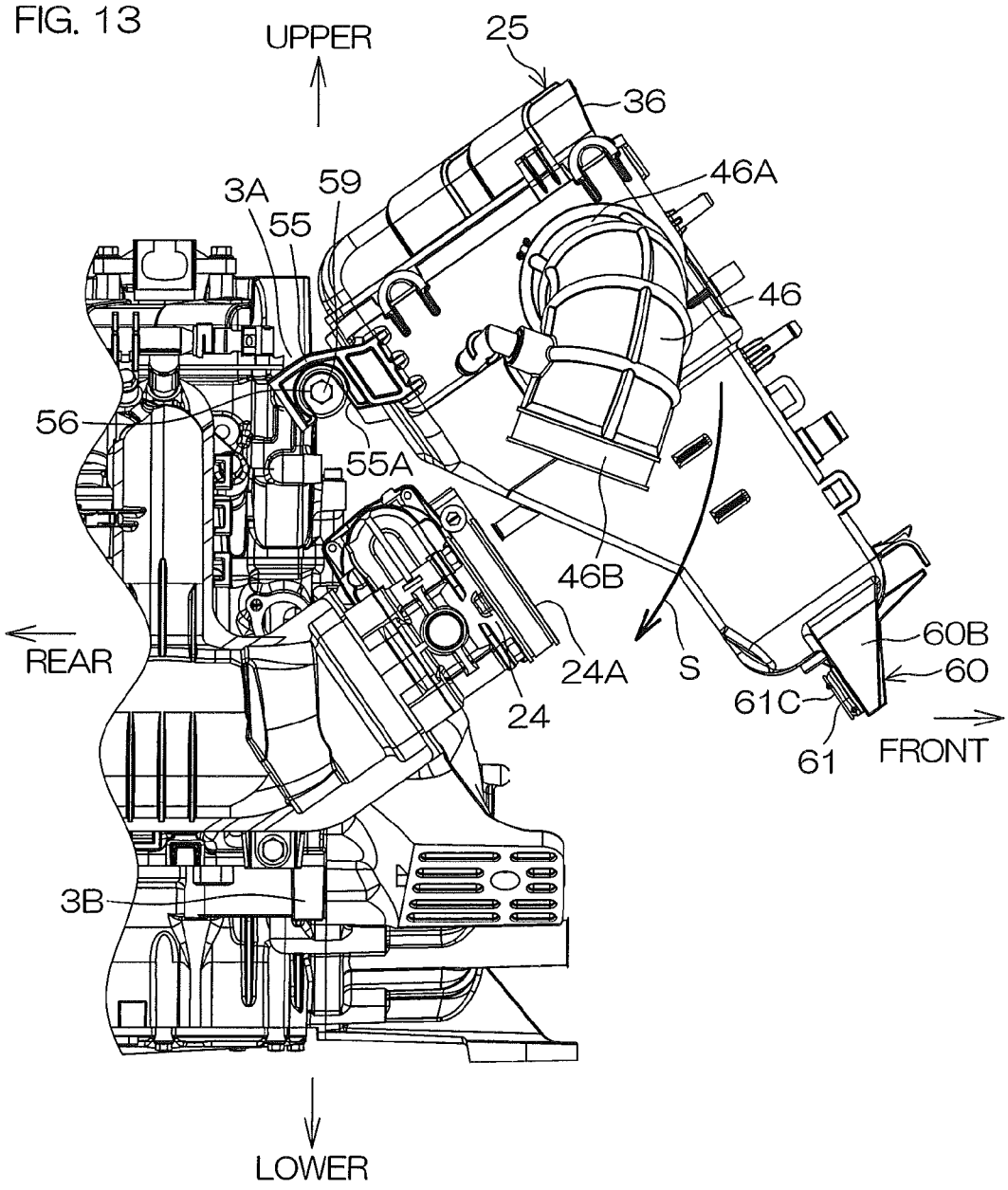
FIG. 13 is a side view showing a state in which the air intake box is mounted on an engine.

FIG. 13 is a right side view showing a state in which the air intake box 25 is mounted on the engine 3.

As shown in FIG. 13, first, the vibration-proof members 56 configured to couple an upper portion of the air intake box 25 to the engine 3 are mounted in advance on the upper coupling portions 3A of the engine 3. In detail, the bolts 59 are inserted through the holes 56A of the right and left vibration-proof members 56, and inserted into the screw holes 58 of the upper coupling portions 3A (refer to FIG. 11A and FIG. 11B). On the other hand, the vibration-proof members 61 configured to couple a lower portion of the air intake box 25 to the engine 3 are mounted in advance on the air intake box 25. In detail, the vibration-proof members 61 are fit into the cut-aways 60C of the right and left lower coupling portions 60 from below.

Next, the air intake box 25 is grasped by the user and disposed, in a posture of being inclined such that its lower portion is located farther to the front than its upper portion, in front of the engine 3.

Then, with the air intake box 25 maintaining the inclined posture, each of the upper coupling portions 55 in the air intake box 25 is caught on the vibration-proof member 56 already mounted on the engine 3 from above. At this time, the portion bordering the cut-away 55A in the upper coupling portions 55 is fit into the groove 56B on the outer peripheral surface of the vibration-proof member 56 from above (refer to FIG. 11B).

Subsequently, the air intake box 25 is turned obliquely downward toward the rear about a fulcrum of the upper coupling portions 3A (more specifically, the vibration-proof members 56 mounted on the upper coupling portions 3A) of the engine 3. When the rear end surface 61C of the vibration-proof member 61 already mounted on the lower coupling portion 60 of the air intake box 25 contacts the lower coupling portion 3B of the engine 3 from the front, the turning of the air intake box 25 is stopped.

Lastly, the bolt 63 is inserted through the hole 61A of the vibration-proof member 61 and inserted into the screw hole 62 of the lower coupling portion 3B (refer to FIG. 12), and further, the bolt 59 already inserted through the hole 56A of the upper coupling portion 3A of the engine 3 is tightened (refer to FIG. 11A and FIG. 11B). Mounting of the air intake box 25 with respect to the engine 3 is thus complete.

Thus, the air intake box 25 is mounted on the engine 3 via the turning operation using the upper coupling portions 3A as a fulcrum.

Also, when viewed from the right, the direction in which the intake pipe 46 on the right surface 34 of the air intake box 25 extends from the first end portion 46A to the second end portion 46B and the turning direction S of the air intake box 25 that is turned when being mounted on the engine 3 are coincident or substantially coincident. Thus, the second end portion 46B of the intake pipe 46 is connected to the intake-air inlet 24A of the throttle body 24 in the engine 3 at the same time as the air intake box 25 is mounted on the engine 3 via the turning operation.

As described above, the upper coupling portions 55 of the air intake box 25 are mounted on the upper coupling portions 3A of the engine 3, and the air intake box 25 is then turned about a fulcrum of the upper coupling portions 3A. The air intake box 25 is thus easily mounted on the engine 3 without being supported from below. Thus, the stability of the air intake box 25 with respect to the engine 3 is improved.

In particular, by turning the air intake box 25 about a fulcrum of the upper coupling portions 3A located on an upper portion thereof, the air intake box 25 is more easily mounted on the engine 3 without being supported from below. Thus, the stability of the air intake box 25 with respect to the engine 3 is further improved.

Also, the direction in which the intake pipe 46 extends and the turning direction S of the air intake box 25 when being mounted on the engine 3 are coincident or substantially coincident. In this case, by turning and mounting the air intake box 25 on the engine 3, the intake pipe 46 extending from the air intake box 25 is also connected to the engine 3. Thus, the stability of the air intake box 25 with respect to the engine 3 is further improved.

Moreover, by the lower coupling portions 60 provided on a lower portion of the air intake box 25 being mounted on the engine 3, the lower portion of the air intake box 25 is fixed to the engine 3 (refer to FIG. 3).

In addition, through a procedure reverse to the procedure for mounting the air intake box 25 with respect to the engine 3 described above, the air intake box 25 is removed from the engine 3.

Also, in the procedure for mounting the air intake box 25 described above, the cut-aways 55A being recess portions provided for the upper coupling portions 55 of the air intake box 25 are caught from above on the vibration-proof members 56 being projection portions provided in advance for the engine 3, and the air intake box 25 is then turned. Alternatively, the air intake box 25 may be mounted on the engine 3 by providing recess portions on the engine 3, providing projection portions on the air intake box 25, and turning the air intake box 25 after making the projection portions be caught on the recess portions from above.

Figure 14:
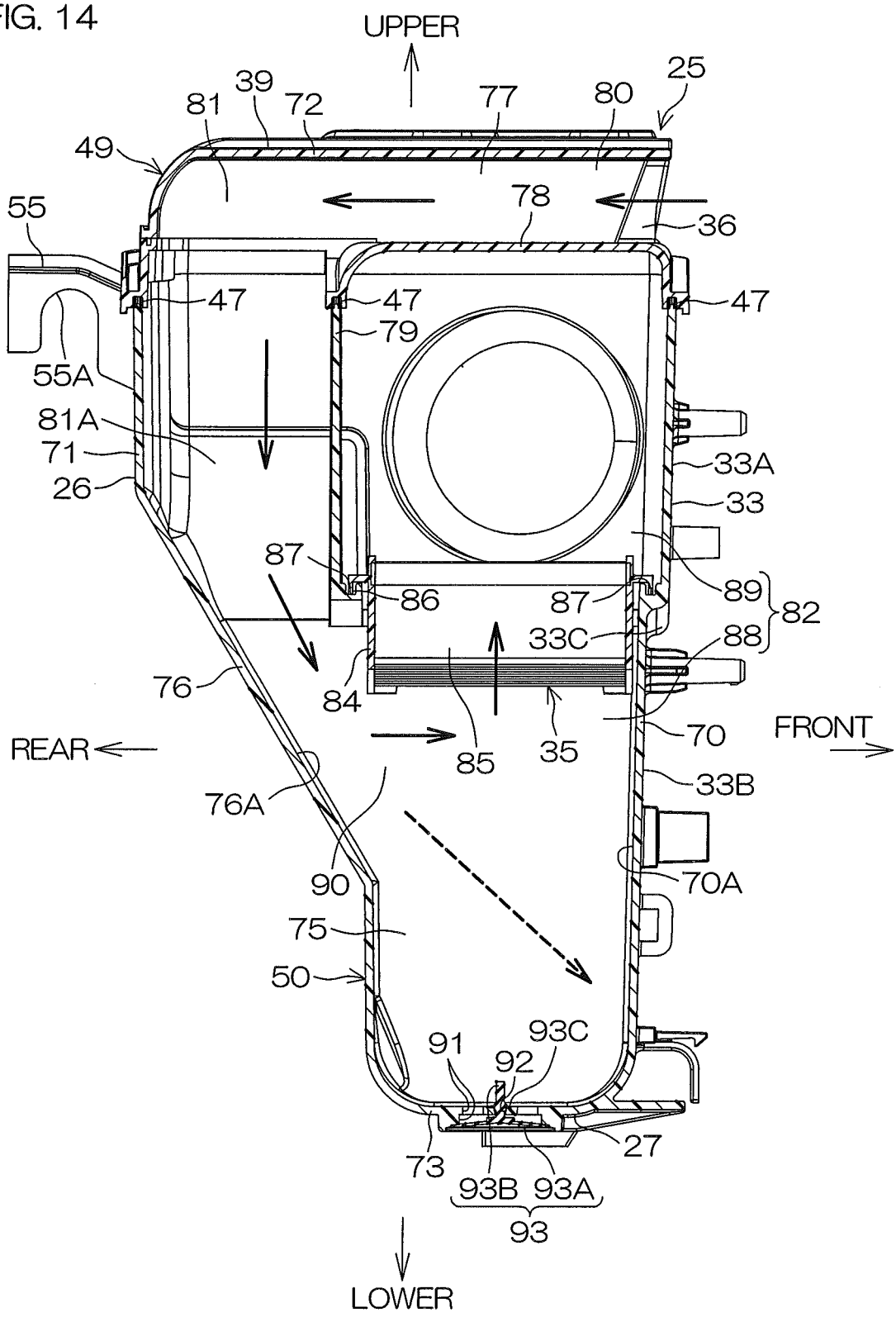
FIG. 14 is a sectional view of the air intake box along a plane extending in the up-down and front-rear directions.
Figure 15:
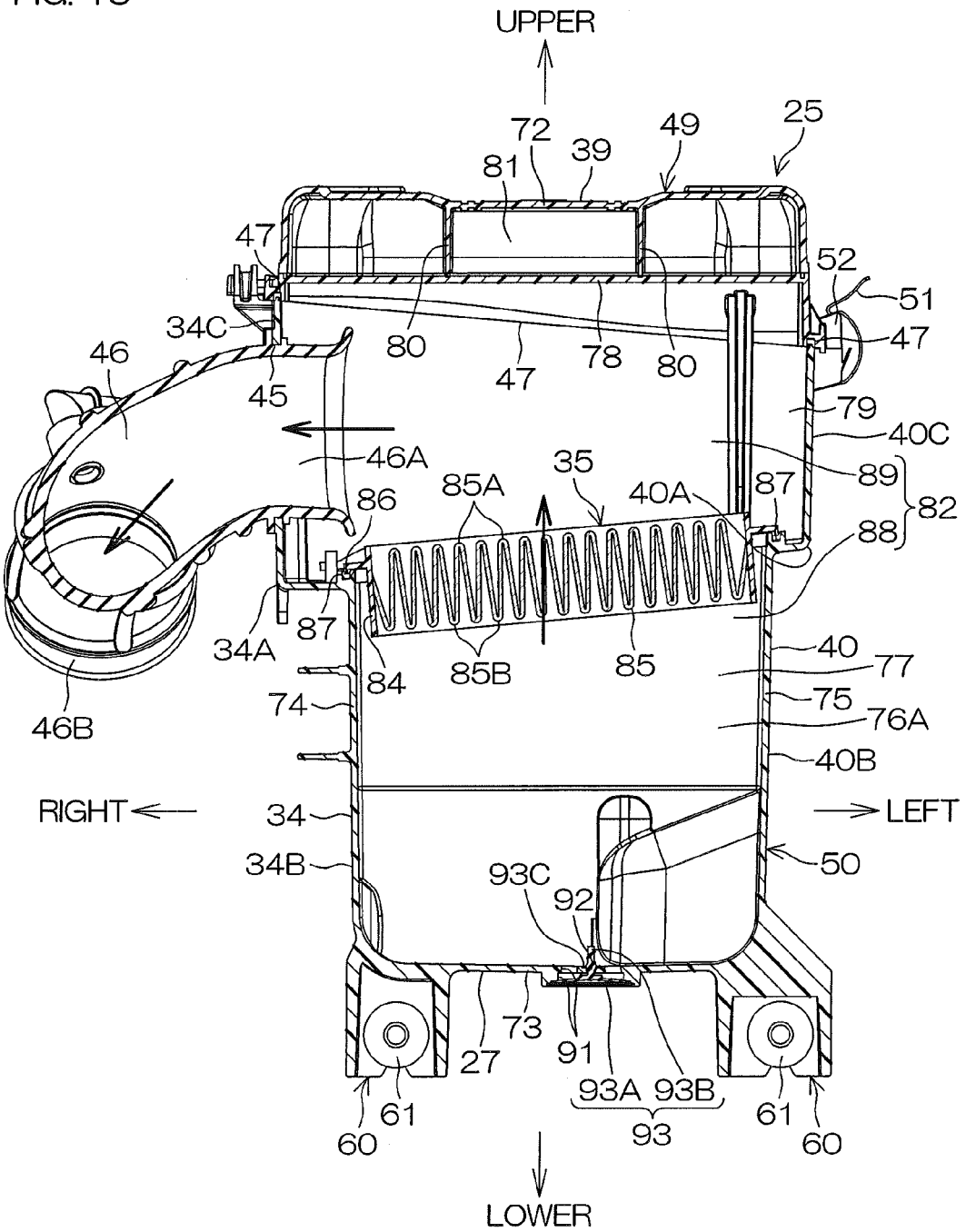
FIG. 15 is a sectional view of the air intake box along a plane extending in the up-down and right-left directions.

FIG. 14 is a sectional view of the air intake box 25 when cut along a plane extending in the up-down and front-rear directions. FIG. 15 is a sectional view of the air intake box 25 when cut along a plane extending in the up-down and right-left directions.

As shown in FIG. 14, the air intake box 25 includes a front wall 70 and a rear wall 71 that are thin in the front-rear direction and a top wall 72 and a bottom wall 73 that are thin in the up-down direction. A front surface of the front wall 70 corresponds to the front surface 33 of the air intake box 25. A rear surface of the rear wall 71 corresponds to the rear surface 26 of the air intake box 25. An upper surface of the top wall 72 corresponds to the upper surface 39 of the air intake box 25. A lower surface of the bottom wall 73 corresponds to the lower surface 27 of the air intake box 25.

An upper end of the front wall 70 is located lower than a front end of the top wall 72, and a gap between the upper end of the front wall 70 and the front end of the top wall 72 corresponds to the inlet 36. A halfway portion of the rear wall 71 in the up-down direction is an inclined wall 76 extending obliquely downward so as to be gradually shifted forward as it extends downward. A front surface 76A of the inclined wall 76 also extends obliquely downward.

As shown in FIG. 15, the air intake box 25 includes a right wall 74 and a left wall 75 that are thin in the right-left direction. A right surface of the right wall 74 corresponds to the right surface 34 of the air intake box 25. A left surface of the left wall 75 corresponds to the left surface 40 of the air intake box 25. The connecting port 45 to which the first end portion 46A of the intake pipe 46 is connected is located in an upper portion of the right wall 74.

As shown in FIG. 14 and FIG. 15, an internal space 77 surrounded by the front wall 70, the rear wall 71, the top wall 72, the bottom wall 73, the right wall 74, and the left wall 75 is provided in the air intake box 25. The internal space 77 brings the inlet 36 and the connecting port 45 into fluid communication with each other.

As shown in FIG. 14, the air intake box 25 includes a first partition wall 78 extending rearward from the upper end of the front wall 70 and a second partition wall 79 extending downward from a rear end of the first partition wall 78.

The first partition wall 78 is thin in the up-down direction, and in the internal space 77, extends parallel or substantially parallel to the top wall 72 at a position lower than the top wall 72, and is arranged in a hanging manner between the right wall 74 and the left wall 75. In addition, a front end portion and a rear end portion of the first partition wall 78 are preferably curved downward. The air intake box 25 includes a plurality of partition walls 80 that are thin in the right-left direction. The partition walls 80 are arranged side by side in the right-left direction, and are arranged in a hanging manner between the top wall 72 and the first partition wall 78 (refer to FIG. 15).

The second partition wall 79 is thin in the front-rear direction, and is arranged in a hanging manner between the right wall 74 and the left wall 75 in the internal space 77. The second partition wall 79 is spaced forward with respect to the entire of the rear wall 71. A lower end of the second partition wall 79 is preferably at the same position in the up-down direction as the inclined wall 76 in the rear wall 71. The lower end of the second partition wall 79 is preferably at the same position in the up-down direction as the center or approximate center of the front wall 70 in the up-down direction.

The first partition wall 78 and the second partition wall 79 partition the internal space 77 into a passage 81 connected to the inlet 36 and a space 82 connected to the connecting port 45. Each of the passage 81 and the space 82 defines a portion of the internal space 77.

The passage 81 bends to extend downward between the rear wall 71 and the second partition wall 79 after extending rearward from the inlet 36 between the top wall 72 and the first partition wall 78. In particular, a substantially lower half of the portion extending downward in the passage 81 extends obliquely downward toward the front along the front surface 76A of the inclined wall 76 of the rear wall 71.

The space 82 preferably has a rectangular parallelepiped or substantially rectangular parallelepiped shape extending up and down at a position farther to the front than the second partition wall 79. An upper end of the space 82 is blocked by the first partition wall 78 from above. A region higher than the step 33C of the front surface 33 in the space 82 is one step wider to the front. A region higher than the step 34A of the right surface 34 and the step 40A of the left surface 40 in the space 82 is one step wider in the right-left direction (refer to FIG. 15).

The air intake box 25 includes the filter 35 discussed above. The filter 35 is configured to clean air taken into the internal space 77 from the inlet 36 and directed to the connecting port 45. The filter 35 includes a frame 84 preferably having a frame shape that is longer in the right-left direction when viewed in the up-down direction and an element 85 set in the frame 84. The frame 84 includes claw-shaped catching portions 86 that are bent downward after projecting to the outside of the frame 84 from upper end portions of front, rear, right, and left side surfaces of the frame 84. The element 85 is preferably made by folding one sheet made of a non-woven fabric or filter paper in a zigzag manner, and when viewed in the front-rear direction, includes a pluralities of peak portions 85A and trough portions 85B that are arranged alternately in the right-left direction (refer to FIG. 15).

The filter 35 is disposed at the center or substantially the center of the space 82 in the up-down direction.

In connection with the disposition of the filter 35, a lower end portion of the second partition wall 79 is bent forward, and on an upper surface of the lower end portion, a receiving portion 87 in the shape of a groove is recessed downward. The receiving portion 87 is also provided in each of a portion that is coincident with the step 33C of the front surface 33 in a rear surface of the front wall 70, a portion that is coincident with the step 34A of the right surface 34 in a left surface of the right wall 74, and a portion that is coincident with the step 40A of the left surface 40 in a right surface of the left wall 75 (refer also to FIG. 15). Due to the catching portions 86 of the frame 84 being caught on the receiving portions 87 from above, the filter 35 is fixed with respect to the air intake box 25 and positioned in the space 82. In addition, the filter 35 being in the positioned state is not necessarily arranged perfectly along the horizontal direction, and may be slightly inclined with respect to the horizontal direction such that, for example, a left end portion is located higher than a right end portion (refer to FIG. 15).

The filter 35 divides the space 82 into a lower region 88 located lower than the filter 35 and an upper region 89 located higher than the lower region 88 with the filter 35 therebetween.

The passage 81 is connected at its lower end to a substantially upper half of the lower region 88 from behind, and brings the inlet 36 and the lower region 88 into fluid communication. Thus, the lower region 88 is connected to the inlet 36 via the passage 81. The filter 35 is located higher than the connecting portion 90 of the passage 81 and the lower region 88. More specifically, the element 85 through which air is passed in the filter 35 is located higher than the connecting portion 90.

The bottom wall 73 defines a lower end of the lower region 88. In the bottom wall 73, an outlet 91 that penetrates through the bottom wall 73 in the up-down direction is provided. The outlet 91 preferably has a circular or substantially circular shape in the lower surface 27 of the bottom wall 73, and an upper surface of the bottom wall 73 includes a disconnected annular circumferential portion. An insertion hole 92 that penetrates through the bottom wall 73 in the up-down direction is provided in a portion surrounded by the annular outlet 91 in the upper surface of the bottom wall 73.

The air intake box 25 includes a valve 93 that opens and closes the outlet 91 from below. The valve 93 is preferably a check valve, and the entire of the valve 93 is preferably made of an elastic material such as rubber. The valve 93 is integral and unitary with a disk-shaped main body 93A and a support portion 93B including a shaft projecting upward from a center position of the main body 93A.

An upper surface of the main body 93A is preferably a tapered surface that widens as it extends downward. The main body 93A is disposed lower than the outlet 91. A catching portion 93C that extends outward in the shape of a flange from an outer peripheral surface of the support portion 93B is located halfway through the support portion 93B in the up-down direction. The support portion 93B is inserted through the insertion hole 92 of the bottom wall 73, and the catching portion 93C is caught on a portion bordering the insertion hole 92 in the upper surface of the bottom wall 73 from above.

As shown in FIG. 14, in the state where the main body 93A is in contact with a portion bordering the outlet 91 in the lower surface 27 of the bottom wall 73 from below, the valve 93 closes the outlet 91.

As shown in FIG. 15, the connecting port 45 is connected to the upper region 89 from the right. The connecting port 45 is disposed higher than the filter 35. The first end portion 46A of the intake pipe 46 connected to the connecting port 45 extends out into the upper region 89.

As shown in FIG. 14 and FIG. 15, the flow of air taken into the internal space 77 from the inlet 36 and directed to the connecting port 45 is shown by the thick-line arrows. In the internal space 77, the passage 81 is located upstream of the lower region 88, and the lower region 88 is located upstream of the upper region 89.

Thus, as shown in FIG. 14, the air taken in from the inlet 36, inside the passage 81, flows rearward along the top wall 72 and the first partition wall 78, and subsequently flows downward along the rear wall 71. Then, in a lower portion inside the passage 81, the air flows obliquely downward toward the front along the front surface 76A of the inclined wall 76 of the rear wall 71.

The air having reached the lower end of the passage 81 flows into the lower region 88 from the connecting portion 90 of the passage 81 and the lower region 88, and changes its flow direction to upward in the lower region 88. In detail, the rear surface of the front wall 70 is located ahead of air flowing along the front surface 76A of the inclined wall 76. The rear surface of the front wall 70 defines a separation surface 70A that defines a portion of the surfaces that define the lower region 88. The air that has passed through the passage 81 along the front surface 76A of the inclined wall 76 and flowed in the lower region 88 from the connecting portion 90 collides with the separation surface 70A as shown by the thick broken-line arrow. The separation surface 70A, due to the air colliding therewith, separates moisture from the air. Also, the separation surface 70A changes the flow direction of the collided air to upward.

Thus, air having flowed in the lower region 88 flows upward inside the lower region 88. Then, the air having flowed upward inside the lower region 88 passes through the element 85 of the filter 35. At that time, as a result of dust and dirt, etc., contained in the air being removed by the element 85, the air is cleaned.

As shown in FIG. 15, the air cleaned by the filter 35 flows into the upper region 89. The air having flowed in the upper region 89 changes its flow direction to rightward, and flows into the intake pipe 46 from the connecting port 45. The air having flowed in the intake pipe 46 is supplied to the engine 3 via the throttle body 24.

As shown in FIG. 14, the moisture separated from the air by the separation surface 70A inside the lower region 88 falls due to its own weight, and accumulates in the lower region 88. Water that has flowed in from the inlet 36 and fallen due to its own weight before colliding with the separation surface 70A also accumulates in the lower region 88. The water accumulated in the lower region 88 weighs on the main body 93A of the valve 93 from above in the outlet 91. When a certain amount or more of water has accumulated in the lower region 88, the valve 93 can no longer bear the weight of the water. Then, in the valve 93, elastic deformation occurs such that an outer peripheral portion of the main body 93A is curved downward and/or elastic deformation occurs such that the support portion 93B is stretched downward. The valve 93 is thus shifted downward from the outlet 91 of the bottom wall 73 to open the outlet 91. The water accumulated in the lower region 88 is discharged downward from the opened outlet 91. When the water accumulated in the lower region 88 has been discharged, the valve 93 returns to its shape before elastic deformation, and again closes the outlet 91.

As shown in FIG. 9, the cover portion 49 that defines an upper portion of the air intake box 25 includes the top wall 72 and the first partition wall 78 and portions higher than the boundary 47 in each of the rear wall 71, the right wall 74, and the left wall 75. Thus, a portion that extends rearward from the inlet 36 between the top wall 72 and the first partition wall 78 in the passage 81 is provided in the cover portion 49. When the cover portion 49 is removed, in the main body portion 50, the space 82 is exposed to above so that the filter 35 in the space 82 can be accessed.

Figure 16A:
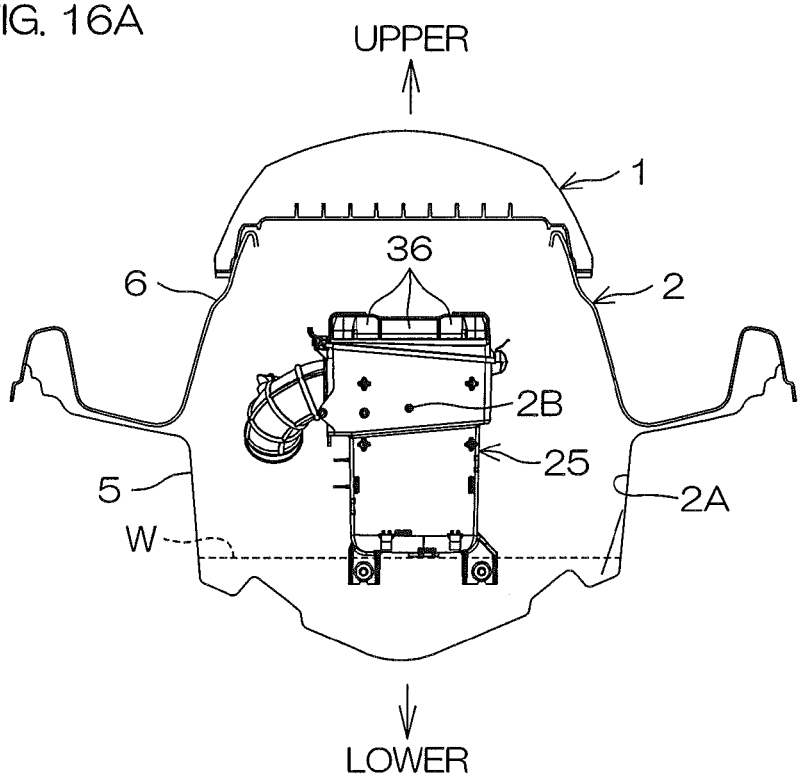
FIG. 16A is a sectional view of the jet propelled watercraft along a plane extending in the up-down and right-left directions.
Figure 16B:
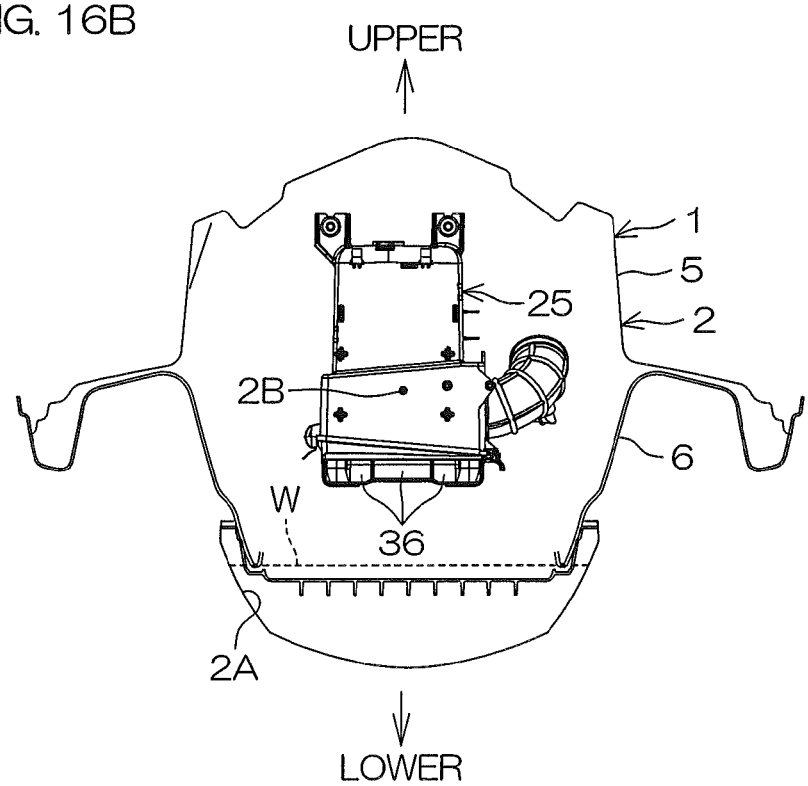
FIG. 16B is a sectional view of the jet propelled watercraft in an overturned state along a plane extending in the up-down and right-left directions.

FIG. 16A is a sectional view of the jet propelled watercraft 1 along a plane extending in the up-down and right-left directions. FIG. 16B is a sectional view of the jet propelled watercraft 1 in an overturned state along a plane extending in the up-down and right-left directions.

The jet propelled watercraft 1 of FIG. 16A is in a normal state where the deck 6 is located higher than the hull 5. On the other hand, the jet propelled watercraft 1 of FIG. 16B is in an overturned state where the hull 5 is located higher than the deck 6. Also, the jet propelled watercraft 1 may be considered to be in a state of being overturned when lying on its side between the normal state and the overturned state.

The air intake box 25 is, in a state of being accommodated in the watercraft body 2, located at a predetermined distance from an inner surface 2A of the watercraft body 2. In particular, the inlet 36 of the air intake box 25 is set so as to be always separated upward by a predetermined distance from a lower end of the inner surface 2A of the watercraft body 2 in any state of the jet propelled watercraft 1. The inlet 36 is disposed so as to be close to a center 2B of a section of the watercraft body 2 along a plane extending in the up-down and right-left directions so that such an arrangement is achieved.

Thus, in the case of entry of water into the watercraft body 2, the inlet 36 is disposed higher than a water level W of the water having flowed in the watercraft body 2 in any state of the jet propelled watercraft 1. For example, even when the jet propelled watercraft 1 changes from a normal state into an overturned state with water having entered into the watercraft body 2, the possibility that water flowing along the inner surface 2A inside the watercraft body 2 flows into the interior of the air intake box 25 from the inlet 36 is significantly reduced or prevented.

The arrangement where water is unlikely to flow into the interior of the intake box 25 from the inlet 36 as such allows saving the time and effort of applying water-repelling treatment to the filter 35 such that water does not flow into the air intake box 25 and pass through the filter 35.

As described above, the air intake box 25 takes ambient air into the internal space 77 from the inlet 36. As shown in FIG. 14, the filter 35 disposed in the space 82 defining a portion of the internal space 77 cleans air taken into the internal space 77. The cleaned air is directed to the connecting port 45 in the internal space 77, and supplied to the engine 3 by the intake pipe 46 from the connecting port 45.

The filter 35 divides the space 82 in which the filter 35 is disposed into upper and lower regions of the lower region 88 connected to the inlet 36 and the upper region 89 located higher than the lower region 88 and connected to the connecting port 45. In this case, a fluid that flows inside the internal space 77 from the inlet 36 toward the connecting port 45 needs to rise when moving to the upper region 89 from the lower region 88. Thus, even when water flows into the internal space 77 from the inlet 36, because the water has difficulty in rising from the lower region 88 to the upper region 89 due to its own weight, it thus cannot reach the connecting port 45. Accordingly, the water cannot reach the engine 3 through the connecting port 45.

As a result, when water flows into the interior of the air intake box 25, entry thereof into the engine 3 is prevented.

Even if water having flowed into the internal space 77 passes through the filter 35, the water, due to its own weight, cannot reach the connecting port 45 (refer to FIG. 15) disposed higher than the filter 35. Accordingly, when water flows into the interior of the air intake box 25, entry thereof into the engine 3 is further prevented.

A fluid that flows along the passage 81 obliquely downward from the inlet 36 toward the lower region 88, when having flowed in the lower region 88 beyond the connecting portion 90 of the passage 81 and the lower region 88, cannot reach the filter 35 unless its flow direction is changed to upward. In this case, water having flowed into the passage 81 from the inlet 36 is urged by the passage 81 so as to flow obliquely downward (refer to the thick broken-line arrow in FIG. 14). The water that flows along the passage 81, due to inertial force, when having flowed in the lower region 88, thus cannot change its flow direction to upward, and thus cannot reach the filter 35. Thus, the water that flows along the passage 81 also cannot pass through the filter 35 to reach the connecting port 45. Accordingly, when water flows into the interior of the air intake box 25, entry thereof into the engine 3 is further prevented.

The fluid that flows along the passage 81 from the inlet 36 toward the lower region 88, when having passed through the passage 81 to flow in the lower region 88, collides with the separation surface 70A. The fluid is thus separated into air and moisture. The air rises from the lower region 88 to reach the upper region 89. On the other hand, the water, due to its own weight, has difficulty in rising from the lower region 88 to the upper region 89, and thus accumulates in the lower region 88 without reaching the connecting port 45. Accordingly, when water flows into the interior of the air intake box 25, entry thereof into the engine 3 is further prevented.

In addition, due to air whose flow direction has been inverted from downward to upward in the lower region 88, a turbulent flow of air is generated in the lower region 88, and the turbulent flow also separates moisture in the air.

Because water accumulated in the lower region 88 is discharged from the outlet 91, water is prevented from reaching the connecting port 45 of the water accumulated in the lower region 88. Accordingly, when water flows into the interior of the air intake box 25, entry thereof into the engine 3 is further prevented.

Due to the valve 93 opening the outlet 91 when a certain amount of water has accumulated in the lower region 88, the certain amount of water accumulated in the lower region 88 is collectively discharged.

The passage 81 of which a portion is defined in an upper portion of the air intake box 25 inevitably includes a portion 81A that extends downward toward the lower region 88. A fluid that flows along the passage 81 downward toward the lower region 88 thus needs to change its flow direction to upward in a section from the passage 81 to the upper region 89. In this case, water having flowed into the passage 81 from the inlet 36 is urged by the passage 81 so as to flow downward. The water that flows along the passage 81, due to inertial force, thus cannot change its flow direction to upward, and thus cannot reach the upper region 89 and also cannot reach the connecting port 45. Accordingly, when water flows into the interior of the air intake box 25, entry thereof into the engine 3 is further prevented.

As shown in FIG. 9, separating the air intake box 25 into the cover portion 49 defining an upper portion of the air intake box 25 and the main body portion 50 allows performing maintenance in the internal space 77 of the air intake box 25.

As shown in FIG. 16A and FIG. 16B, even in the case of entry of water into the watercraft body 2, because the inlet 36 is disposed higher than the water level W in the watercraft body 2, inflow of water from the inlet 36 to the internal space 77 is prevented.

Figure 17:
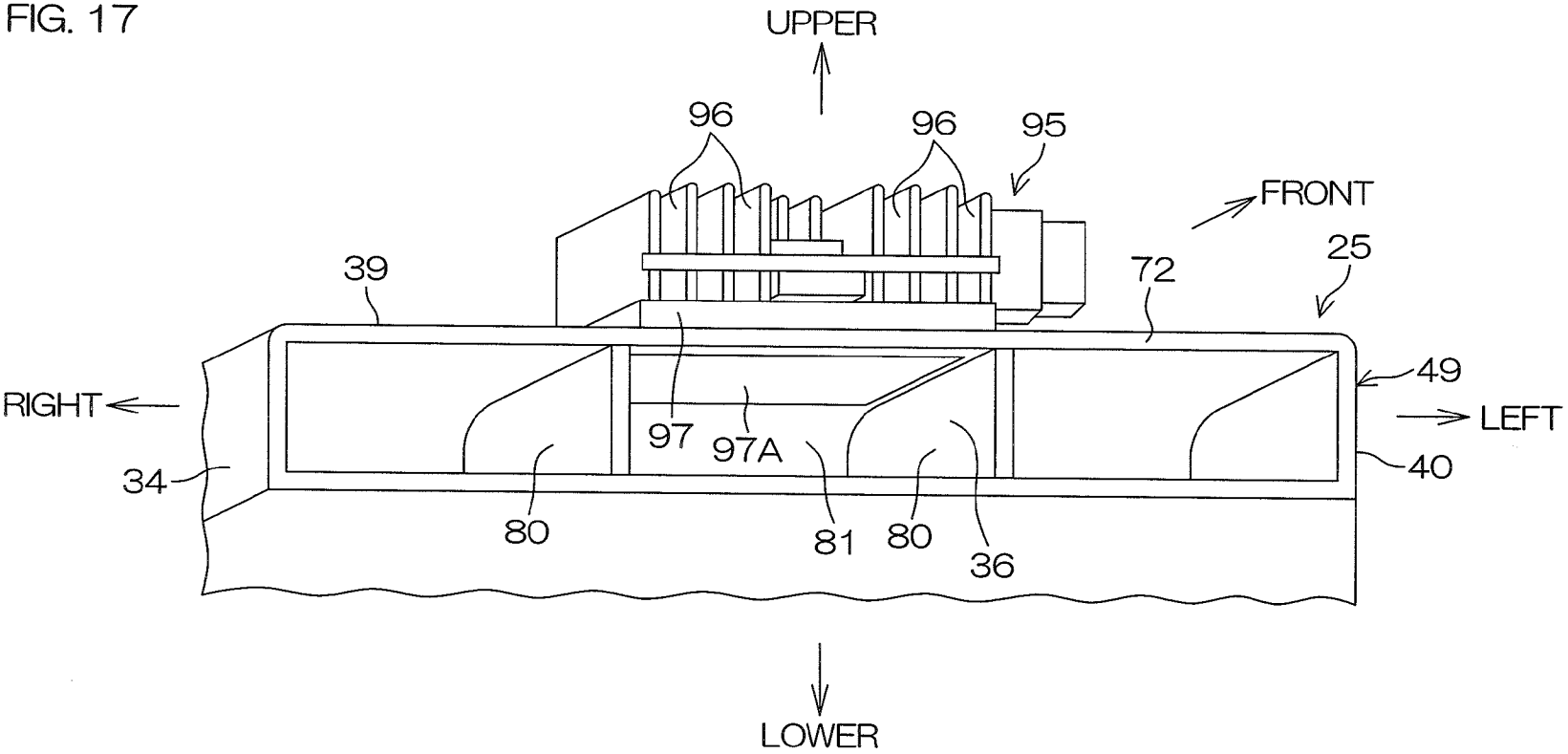
FIG. 17 is a schematic perspective view of an upper portion of the air intake box.

FIG. 17 is a schematic perspective view of an upper portion of the air intake box 25.

As shown in FIG. 17, the jet propelled watercraft 1 is provided with a REC/REG 95 for which a rectifier configured to convert an alternating current generated by a generator (not shown) into a direct current and a regulator configured to control voltage to a certain value or less are integrated with each other.

The REC/REG 95 generates heat and is thus provided with a plurality of heat radiating fins 96. The fins 96 are cooled by contacting the ambient air. When such an air-cooled REC/REG 95 is mounted on the engine 3, because the ambient temperature of the REC/REG 95 is high, the heat radiating effect of the REC/REG 95 deteriorates. However, when a water-cooled REC/REG 95 is used, an increase in the cost becomes a concern.

Thus, the REC/REG 95 is preferably mounted on the upper surface 39 of the air intake box 25 so as to be effectively cooled by air taken in by the inlet 36 of the air intake box 25. In detail, the REC/REG 95 is mounted from above on a metallic plate 97 that is thin in the up-down direction. The plate 97 is mounted on the top wall 72 of the air intake box 25 such that its lower surface 97A is disposed to the inside of the passage 81. To fix the REC/REG 95 and the plate 97 and to fix the top wall 72 and the plate 97, fastening members such as bolts are preferably used.

In this case, heat generated by the REC/REG 95 is conducted to the plate 97. The plate 97 is cooled by air taken into the inlet 36 and flows inside the passage 81. Thus, even with a low-cost arrangement using an air-cooled REC/REG 95, a high heat radiating effect is obtained.

Although preferred embodiments of the present invention have been described above, the present invention is not restricted to the contents of the preferred embodiments and various modifications are possible within the scope of the present invention.

Also, features of two or more of the various preferred embodiments described above may be combined.

The present application claims priority to Japanese Patent Application No. 2014-158127 filed on Aug. 1, 2014 in the Japan Patent Office, and the entire disclosure of which is incorporated herein by reference in its entirety.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A jet propelled watercraft comprising:

a watercraft body;

an engine including a crankshaft configured to rotate about a crank axis extending in a longitudinal direction of the watercraft body, and accommodated in the watercraft body;

a jet pump configured to generate a jet thrust by sucking in and ejecting water by a driving force of the engine;

an intake pipe connected to the engine and configured to supply air to the engine;

an air intake box including a connecting port connected to the intake pipe, an inlet configured to take in ambient air, and an internal space configured to connect the connecting port and the inlet to each other such that fluid flows between the connecting port and the inlet; and a filter configured to clean air taken into the internal space from the inlet and directed to the connecting port, disposed in a space included in the internal space, and configured to divide the space into a lower region and an upper region, the lower region being connected to the inlet, the upper region being located higher than the lower region and connected to the connecting port; wherein the inlet is located above the lower region; and the connecting port is located in the upper region.

2. The jet propelled watercraft according to claim 1, wherein the connecting port is disposed higher than the filter.

3. The jet propelled watercraft according to claim 1, wherein the air intake box is accommodated in the watercraft body, and the inlet is disposed higher than a water level in the watercraft body in a case of entry of water into the watercraft body.

4. A jet propelled watercraft comprising:

a watercraft body;

an engine including a crankshaft configured to rotate about a crank axis extending in a longitudinal direction of the watercraft body, and accommodated in the watercraft body;

a let pump configured to generate a let thrust by sucking in and electing water by a driving force of the engine;

an intake pipe connected to the engine and configured to supply air to the engine;

an air intake box including a connecting port connected to the intake pipe, an inlet configured to take in ambient air, and an internal space configured to connect the connecting port and the inlet to each other such that fluid flows between the connecting port and the inlet; and a filter configured to clean air taken into the internal space from the inlet and directed to the connecting port, disposed in a space included in the internal space, and configured to divide the space into a lower region and an upper region, the lower region being connected to the inlet, the upper region being located higher than the lower region and connected to the connecting port; wherein the air intake box includes a passage included in the internal space;

the passage is configured to connect the inlet and the lower region to each other such that fluid flows between the inlet and the lower region;

the passage extends obliquely downward and is connected at its lower end to the lower region; and the filter is located higher than a connecting portion of the passage and the lower region.

5. The jet propelled watercraft according to claim 1, wherein the air intake box includes a passage in the internal space and a separation surface in the lower region;

the passage is configured to connect the inlet and the lower region to each other such that fluid flows between the inlet and the lower region; and the separation surface is configured to separate moisture from air due to the air having passed through the passage and flowed into the lower region colliding therewith.

6. The jet propelled watercraft according to claim 4, wherein the air intake box includes a bottom wall defining a lower end of the lower region; and in the bottom wall, an outlet is provided to discharge water accumulated in the lower region.

7. The jet propelled watercraft according to claim 6, wherein the air intake box includes a valve configured to open and close the outlet.

8. The jet propelled watercraft according to claim 4, wherein a portion of the passage is located in an upper portion of the air intake box.

9. The jet propelled watercraft according to claim 8, wherein the air intake box includes a cover portion defining the upper portion of the air intake box and a main body portion, which is a portion other than the cover portion, and to and from which the cover portion is attached and detached.

10. A jet propelled watercraft comprising:

a watercraft body;

an engine including a first coupling portion and accommodated in the watercraft body;

a jet pump configured to generate a jet thrust by sucking in and ejecting water by a driving force of the engine; and an air intake box including a second coupling portion mounted on the first coupling portion; wherein the air intake box pivots about a fulcrum, defined by a portion of the first coupling portion where the second coupling portion is mounted on the first coupling portion, to mount the air intake box to the engine.

11. A jet propelled watercraft comprising:

a watercraft body;

an engine including a first coupling portion and accommodated in the watercraft body;

a jet pump configured to generate a jet thrust by sucking in and ejecting water by a driving force of the engine; and an air intake box including a second coupling portion mounted to the first coupling portion, configured to turn using the first coupling portion as a fulcrum, and configured to be mounted on the engine via a turning operation; wherein the second coupling portion is mounted on an upper portion of the air intake box.

12. The jet propelled watercraft according to claim 10, further comprising an intake pipe extending from the air intake box and connected to the engine, and configured to supply air to the engine from the air intake box; wherein a direction in which the intake pipe extends and a direction of the pivoting operation when the air intake box is mounted to the engine are coincident or substantially coincident.

13. A jet propelled watercraft comprising:

a watercraft body;

an engine including a first coupling portion and accommodated in the watercraft body;

a let pump configured to generate a let thrust by sucking in and electing water by a driving force of the engine;

an air intake box including a second coupling portion mounted to the first coupling portion, configured to turn using the first coupling portion as a fulcrum, and configured to be mounted on the engine via a turning operation; and a third coupling portion provided on a lower portion of the air intake box and configured to mount the air intake box to the engine.

* * * * *